US012391422B1

(12) United States Patent
Robb et al.

(10) Patent No.: US 12,391,422 B1
(45) Date of Patent: Aug. 19, 2025

(54) SEALING MECHANISM WITH PUNCHES AND DIES FOR SECURING PACKAGES

(71) Applicant: Amazon Technologies, Inc., Seattle, WA (US)

(72) Inventors: Larry Joe Robb, Mount Juliet, TN (US); Garett Ochs, Seattle, WA (US); Hang Tran Nguyen-Grove, Kirkland, WA (US); Jacqueline Rose Lerro, Newark, DE (US); Anupam Dighe, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 216 days.

(21) Appl. No.: 17/903,574

(22) Filed: Sep. 6, 2022

(51) Int. Cl.

| | |
|---|---|
| ***B65B 61/02*** | (2006.01) |
| ***B65B 5/04*** | (2006.01) |
| ***B65B 7/06*** | (2006.01) |
| ***B65B 41/16*** | (2006.01) |
| ***B65B 67/08*** | (2006.01) |
| ***B65D 77/12*** | (2006.01) |

(52) U.S. Cl.
CPC ..... *B65B 61/02* (2013.01); *B65B 5/04* (2013.01); *B65B 7/06* (2013.01); *B65B 41/16* (2013.01); *B65B 67/08* (2013.01); *B65D 77/12* (2013.01)

(58) Field of Classification Search
CPC ..... B65B 5/04; B65B 67/08; B65D 44/12
See application file for complete search history.

(56) References Cited

U.S. PATENT DOCUMENTS

| | | | | |
|---|---|---|---|---|
| 3,822,528 | A * | 7/1974 | Carlsson | B65B 5/061 53/542 |
| 3,912,575 | A * | 10/1975 | Zelnick | B29C 65/7441 493/203 |
| 3,930,350 | A * | 1/1976 | Reid | B65B 9/06 53/511 |
| 4,000,029 | A * | 12/1976 | Michaels | B29C 65/18 156/510 |
| 4,044,524 | A * | 8/1977 | Segale | B65B 9/06 53/433 |
| 5,177,931 | A * | 1/1993 | Latter | B65B 61/18 493/929 |
| 5,411,202 | A * | 5/1995 | Fenini | B65D 75/68 229/87.05 |
| 6,309,104 | B1 * | 10/2001 | Koch | B65D 75/58 383/200 |
| 6,993,887 | B2 * | 2/2006 | Dharssi | B65B 25/16 53/445 |
| 9,718,568 | B2 * | 8/2017 | Vardakostas | B65B 43/14 |
| 11,059,617 | B1 * | 7/2021 | Burgess | B65B 61/16 |

(Continued)

*Primary Examiner* — Lucas E. A. Palmer
(74) *Attorney, Agent, or Firm* — Eversheds Sutherland (US) LLP

(57) ABSTRACT

Packaging material is folded around an item. First punches are actuated to pierce through the packaging material at a first location, and first dies are actuated to receive a portion of individual first punches of the first punches. Second punches are actuated to pierce through the packaging material at a second location, and second dies are actuated to receive a portion of individual second punches of the second punches. A first press compresses the packaging material at the first location, and a second press compresses the packaging material at the second location.

17 Claims, 16 Drawing Sheets

(56) References Cited

U.S. PATENT DOCUMENTS

| | | | | |
|---|---|---|---|---|
| 2005/0276521 | A1* | 12/2005 | Price | B65B 61/16 383/105 |
| 2009/0241487 | A1* | 10/2009 | Actis | B65B 65/00 53/563 |
| 2009/0293431 | A1* | 12/2009 | Andria | B65B 31/06 53/436 |
| 2012/0006718 | A1* | 1/2012 | Waldrop | B65B 25/065 206/557 |
| 2012/0047850 | A1* | 3/2012 | Kemp | A61L 2/07 53/425 |
| 2012/0207410 | A1* | 8/2012 | Moehlenbrock | B65B 9/20 383/95 |
| 2013/0036706 | A1* | 2/2013 | Vaccari | B29C 66/24244 53/79 |
| 2015/0128525 | A1* | 5/2015 | Bartoli | B65D 85/8061 53/410 |
| 2015/0191267 | A1* | 7/2015 | Mochizuki | B65B 9/04 53/373.2 |
| 2015/0259119 | A1* | 9/2015 | Duan-Arnold | A61F 15/001 206/440 |
| 2016/0304226 | A1* | 10/2016 | Rossini | B29C 66/8412 |
| 2017/0129630 | A1* | 5/2017 | Weibel | B65B 31/00 |
| 2017/0297312 | A1* | 10/2017 | Oyama | B65B 53/063 |
| 2018/0178932 | A1* | 6/2018 | Palumbo | B65B 65/003 |
| 2019/0023474 | A1* | 1/2019 | Palumbo | B65D 5/241 |
| 2020/0270048 | A1* | 8/2020 | Goodrich | B32B 29/005 |
| 2021/0214112 | A1* | 7/2021 | Burgess | B65B 61/16 |
| 2021/0292019 | A1* | 9/2021 | Chevalier | B65B 7/164 |
| 2022/0267064 | A1* | 8/2022 | Gonnering | G06Q 10/087 |
| 2022/0402640 | A1* | 12/2022 | Brakkee | B65B 61/007 |

* cited by examiner

SEALING MECHANISM WITH PUNCHES AND DIES FOR SECURING PACKAGES

BACKGROUND

The rise of online purchases has brought about an increase in order fulfillment, packaging, and processing. To meet these demands, automated machines and systems have been developed that package items for shipment. In some cases, the automated machines may individually construct boxes for the items being shipped. However, securely manufacturing the boxes around the items remains a challenge. For example, portions of the box may open and the items may spill out. Such occurrences have a negative impact on order fulfillment and throughput.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The systems depicted in the accompanying figures are not to scale and components within the figures may be depicted not to scale with each other.

DETAILED DESCRIPTION

Figure 1:
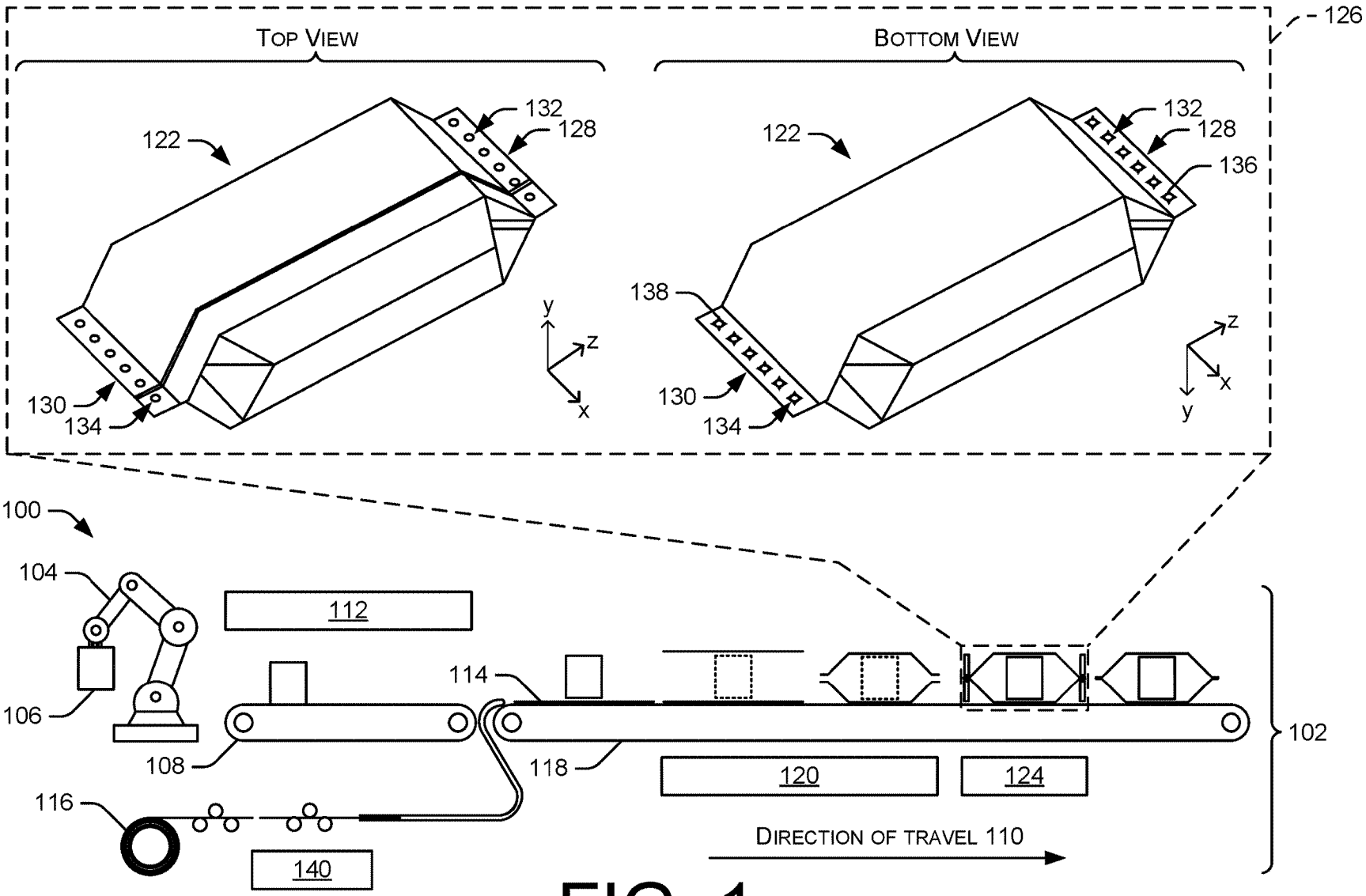
FIG. 1 illustrates an example environment including an example machine having an example sealing mechanism for sealing portions of a container around an item, according to examples of the present disclosure.

This patent application is directed, at least in part, to a sealing mechanism of a machine that cuts, folds, and seals portions of a container. For example, items being processed for shipment may be placed onto a portion of a material that forms the container. Rollers and folders of the machine may be used to form a number of different container configurations, including inward-facing gussets, outward-facing gussets, bent sidewalls, round sidewalls, flat sidewalls, and so forth. After forming the container, portions of the material may be pinched, folded, cinched, adhered, and/or otherwise secured together using the sealing mechanism. For example, the sealing mechanism may include punches that cut and fold the material over itself, thereby cinching the material together. In some instances, the material that is cinched together may be disposed at or along seams (e.g., ends) of the container to prevent the seams opening during transport. Additionally, the sealing mechanism may be used to secure the seams of the container together and allow sufficient time for adhesives to cure. As a result, the items may be secured within the container and throughput may be increased.

Initially, as orders are placed, item(s) associated with the order may be picked. The machine, such as via conveyors, robotic elements, chutes, and so forth, may receive the item(s). The item(s) may be placed onto the portion of the material that forms the container around the item(s). The machine is configured to form the container based at least in part on dimensions of the item(s) to be packaged within the container, the number of item(s) packaged within the container, and/or type of the item(s) packaged within the container. In some instances, the containers may be formed of a single sheet of roll-formed material, such as a paper-based material (e.g., unpadded cardboard, chambered corrugate, single-sided or double-sided corrugate, a non-Gaussian material, etc.). Additionally, the container may take any shape, such as being rectangular, square, cylindrical, and so forth.

After forming the container, or as part of forming the container around the item(s), seams of the container may be secured. For example, using the sealing mechanism, one or more ends of the container may be secured to form the container and/or enclose the item(s) within the container. Generally, the sealing mechanism functions to cut and fold portions of the material together to secure seams of the container and prevent the container opening during transport. For example, after the material is folded around the item(s), ends of the container may be pressed and punched together. As referred to herein, punching may involve the process of forming a hole, such as a slit, through the material. As part of forming the hole, a punched out portion, such as a tab, of the material is created. The tab includes an end that remains connected to the material and an opposite end which is free. Thereafter, presses may compact the seams to compress the punched out portion of the material and a remaining portion of the material together. The pressing secures the seam together and prevents separation of the punch out portions from the material disposed along the seam. Common expressions for this type of securing may be referred to as staple-free stapling.

To further illustrate, two pieces of the material, such as an upper piece and a lower piece may be brought together. The sealing mechanism may include dies, cutters, or punches that respectively cut (i.e., punch) through the material to form the holes and the tabs. More particularly, as the punch extends through the upper piece of the material, a first hole may be created along with a first punched out portion (e.g., tab). As the punch extends further, and through the lower piece of the material, a second hole may be created along with a second punch out portion (e.g., tab). The upper piece of the material and the lower piece of the material are then compressed together, and in doing so, the punched out portions of the upper piece of the material and the lower piece of the material secure the seam together. That is, the punched out portions, which are adjoined to the upper piece of the material and the lower piece of the material, extend beyond a perimeter of the hole to prevent separation of the upper piece of the material and the lower piece of the material.

The punches may include any shape or configuration. For example, the punches may include a needle shaped-punched, such as a being circular, square, hexagonal, and so forth. Moreover, a leading end of the punches may include a tip that pierces into the upper piece of the material and the lower piece of the material. In some instances, the punch may taper inward from the leading end of the punch to a trailing end of the punch in order to avoid the trailing end of the punch snagging (e.g., catching) on the hole formed within the upper piece of the material.

As introduced above, the machine may include a press that squeezes the ends of the upper piece of the material and the lower piece of the material together. In some instances, the press may be actuated while or during the punches are actuated. For example, as the punches pierce through the upper piece of the material and the lower piece of the material, the presses may bring the upper piece of the material and the lower piece of the material together. In some instances, the punches are disposed on or within a first press, located adjacent to an exterior surface of the upper piece of the material, while a die that received the punches are disposed on or within a second press, located adjacent to an exterior of the lower piece of the material. In this manner, as the punches cut through the upper piece of the material and the lower piece of the material, the presses may bring the upper piece of the material and the lower piece of the material together and while the punches remain disposed through the hole. In doing so, the punches prevent the punched out portions of the completely occupying the hole, but rather, the punched out portions extend beyond the holes, adjacent to the exterior surface of the upper piece of the material and/or the lower piece of the material to prevent separation and to secure the upper piece of the material and the lower piece of the material together.

The sealing mechanism may include any number of punches that form the holes along a given length of the material. In some instances, the number of holes may be based on a size of the container, the type of material used to form the container, and/or an amount of material to be secured together. In some instances, the number of holes formed by the punches within the material may be such that a structural integrity of the container is not compromised. For example, in some instances, the number of holes may not exceed eight per ten inches. In some instances, the holes may be spaced apart on twelve millimeter center points. The punched out portions of the material, such as the tabs, may also take any dimensions, but in some instances, may be about six mm in length and four mm in width. In some instances, the size of the tabs may be based at least in part on the size of the container and/or the material used to form the container. However, other sized tabs, and corresponding holes, are envisioned.

The sealing mechanism (or the machine) may include actuators that actuate the punches, dies, and/or the presses. In some instances, biasing members may return the punches and/or the presses to a retracted position. Further, in some instances, the punches and/or the presses may be made up of different sections in order to match a contour of the material being secured together. For example, as ends of the container include overlapping material, such as at/along seams of the container, the end may include different thickness. The different sections may be independently actuatable in order to contour (e.g., shape) to the different thickness. This may, in some instances, assist in further sealing the ends of the container together. For example, a first punch may be disposed within a first press, a second punch may be disposed within a second press, a third punch may be disposed within a third press, and so forth. In some instances, given that the machine may construct differently sized containers, only a predetermined number of the punches may be activated to cinch ends of the container together. For example, the machine may manufacture containers having different widths, and based on the width of the container, certain punches may be activated (via the actuators) and deactivated.

In addition to or alternative from using the sealing mechanism, adhesives may be used to secure the ends of the container. In some instances, adhesives may be applied to surfaces of the material which are brought into contact with one another at the ends of the container, along the upper piece of material and/or the lower piece of the material. The adhesive may be applied prior to the punching and pressing. For example, after the adhesive is applied, the ends of the container may be punched and pressed together. In some instances, this allows for sufficient curing of the adhesive, for example, when the press is released. That is, as the ends of the container are punched together, the punching may prevent the ends of the container disengaging during curing of the adhesive. Punching may therefore assists in holding the ends of the container together to allow for sufficient curing of the adhesive and may reduce the amount of time required for the press to hold ends of the container together.

In some instances, the adhesive may be applied interior to where the ends of the container are punched. In this manner, the punches may not become contaminated (e.g., dirtied) with the adhesive that may adversely impact an operation of the sealing mechanism. Still, in some instances, location of the punches (or the holes formed within the material) may create tear lines to provide assistance during opening of the container. For example, the holes may be arranged along a line and the container may tear apart along the line to enable a consumer to gain access to the items within the container without the use of tools (e.g., knife, scissors, etc.).

Although the machine is described as performing certain functions, the machine may additionally or alternatively perform other functions. For example, the machine may apply labels to the containers to ready the containers for shipment. Additionally, the machine may include components used to form the container, such as sensors that measure dimensions of the item(s) being packaged in order to size the container appropriately. Further, although the above discussion is with regard to punching ends of the container together, the sealing mechanism described herein may be used to adjoin other seams of the container, such as seams along other sides and surfaces of the container.

The sealing mechanism as disclosed herein may reduce an amount of material used during packaging. For example, adhering and punching ends of the container may eliminate the need for staples or other type-fasteners to secure ends (or other seams) of the package together. Advantageously, the sealing mechanism may reduce waste and/or packaging material consumption. Additionally, the sealing mechanism provides a holding force that resists separation of the material while the adhesive cures.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates an example environment 100 including a machine 102 that functions to form containers for items being processed. In some instances, the environment 100 may include a facility in which the items are processed, categorized, and/or otherwise readied for shipment. For example, the environment 100 may include an inventory field (not shown) in which items are located. In some instances, robotic elements may be used to pick the item(s) from the inventory field and delivery the item(s) to the machine 102. Additionally, or alternatively, manual labor or a combination thereof may be used to pick the items. Further, in some instances, conveyor belts and/or other conveyance mechanisms (e.g., rollers, chutes, etc.) may be used to process the item(s) to the machine 102.

The machine 102 includes a plurality of components, stations, or mechanisms for processing the item(s) for shipment. Initially, the item(s) may arrive at the machine 102. A robotic element 104 may pick an item 106 (e.g., among the item(s)) and place the item 106 onto a first conveyor 108. As the item 106 traverses along the first conveyor 108, in a direction of travel 110, one or more cameras or other sensor(s) 112, such as LIDAR sensors, depth sensors, and so forth may be used to determine one or more dimensions of the item 106. For example, the sensor(s) 112 may be used to capture one or more top-down images of the item 106, one or more side-view images of the item 106, and so forth. The sensor(s) 112 may generate data that is used to determine one or more dimensions of the item 106. In some instances, the sensor(s) 112 may be depth cameras or depth sensors used to generate data points that can be processed to determine one or more dimensions of the item 106 (e.g., length, width, height, etc.).

In some instances, the item 106 may traverse along the first conveyor 108 onto a portion of packaging material 114. The packaging material 114 may be a roll-formed packaging material, such as corrugate (e.g., chambered corrugate, single sided corrugate, etc.), or a different packaging material, such as a non-Gaussian packaging material, an unpadded packaging material, or the like. In some instances, the packaging material 114 may include any material that can be creased or bent, and which is capable of being formed into a roll 116. Although a single roll of the packaging material 114 is depicted, in some instances, additional rolls of the packaging material 114 may be included. Additionally, different rolls with different widths may provide flexibility in packaging items of different dimensions.

The packaging material 114 may be cut via a cutting mechanism 140, which cuts the packaging material 114 according to specifics of the item 106 and based on sensor data generated by the sensor(s) 112. For example, based at least in part on the dimensions of the item 106, a length of the packaging material 114 dispensed from the roll 116 may be determined and the cutting mechanism 140 may sever the packaging material 114 accordingly. From the cutting mechanism 140, the packaging material 114 may flow to a second conveyor 118 using belts, rollers, and so forth. The item 106 may therefore flow seamlessly from the first conveyor 108 onto the packaging material 114 on the second conveyor 118.

In addition to the length of packaging material 114, a width between fold lines of the packaging material 114 may be determined. The width between fold lines may correspond to a width of the item 106. Generally, the fold lines may be creases, score lines, perforations, or other features that facilitate bending of the packaging material 114. In some instances, the fold lines may be embossed, serrated, perforated, texturized, or otherwise deformed. To form the fold lines onto/into the packaging material 114, one or more adjustable rollers or dies may be used. Such process may occur as the packaging material 114 and the item 106 traverse along the second conveyor 118. Additional details of forming the fold lines, or forming a custom container for an item, are discussed in, for example, U.S. patent application Ser. No. 16/871,767, filed May 11, 2020, entitled "Roll-Formed Containers for Shipping," the entirety of which is herein incorporate by reference for all purposes.

As the packaging material 114 is fed forward, in the direction of travel 110, an adhesive or sealant, such as a hot melt glue, pressure-sensitive adhesive, tape, glue, thermal sealing component, or other adhesive or sealant may be applied about one or more edges and/or the width of the packaging material 114. For example, in some embodiments, adhesive may be applied to three sides of the packaging material 114. The adhesive may be absent on a side that comes into contact or is disposed adjacent to the item 106 once the packaging material 114 is folded. To apply the adhesive, the adhesive may be sprayed, applied in a beaded or spiral pattern, or otherwise distributed along one or more surfaces of the packaging material 114.

After the adhesive is applied, the packaging material 114 and the item 106 may continue to a folding station 120 whereby a container 122 (via the packaging material) is at least partially formed around the item 106. For example, the folding station 120 may include one or more folders that are used to fold a first side of the packaging material 114 over the item 106, and a second side of the packaging material 114 over the first side of the packaging material 114. This folding creates an overlap between the first side and the second side. After the sides are folded, the sides may be pressed to cause the adhesive to bind the overlap together to form a seal along a top of the item 106. Additionally, or alternatively, the folders may be used to form inward-facing or outward-facing gussets along sides of the item 106, or to form sides of the container 122.

The packaging material 114 may then arrive at a sealing mechanism 124 that functions to enclose the packaging material 114 at longitudinal ends of the container 122. More specifically, the sealing mechanism 124 serves to enclose longitudinal ends of the container 122 to enclose the item 106. A detailed view 126 of the container 122, as formed at least partially by the sealing mechanism 124, is shown in FIG. 1. The detailed view 126 illustrates a top view of the container 122 and a bottom view of the container 122.

As will be explained herein, the sealing mechanism 124 includes presses that compress the packaging material 114 at a first longitudinal end 128 and a second longitudinal end 130 of the container 122. The first longitudinal end 128 may be a leading end (relative to the direction of travel 110), while second longitudinal end 130 may be a trailing end and spaced apart from the leading end (e.g., in the Z-direction). A first press may press the packaging material 114 together at the first longitudinal end 128, while a second press may press the packaging material 114 together at the second longitudinal end 130.

The sealing mechanism 124 further includes punches that form holes within the packaging material 114. For example, first punches may form first holes 132 (e.g., slits, openings, voids, etc.) through the packaging material 114 at the first longitudinal end 128 and second punches may form second holes 134 (e.g., slits, openings, voids, etc.) through the packaging material 114 at the second longitudinal end 130. The first punches and the second punches may vertically actuate (e.g., in the Y-direction) to pierce through the packaging material 114. During this, the first punches and the second punches form first tabs 136 and second tabs 138, respectively, from the packaging material 114 (e.g., the punched portions of the packaging material 114). With continued actuation of the first punches and the second punches, the first tabs 136 and the second tabs 138 are pushed through the first holes 132 and the second holes 134, respectively, or while the first holes 132 and the second holes 134 are formed. The tabs, however, remain connected to the packaging material 114. By pressing the packaging material 114 together, at the first longitudinal end 128 and the second longitudinal end 130, respectively, the packaging material 114 is bound together, and the packaging material 114 at the first longitudinal end 128 and a second longitudinal end 130 resist separation.

In some instances, punching the longitudinal ends of the container 122 together may allow for sufficient curing of the adhesive, for example, when the press is released. That is, as the longitudinal ends of the container 122 are punched together, and held in place at least in part by the first tabs 136 and the second tabs 138, the first tabs 136 and the second tabs 138 hold the longitudinal ends of the container 122 together to allow for sufficient curing of the adhesive. In some instances, punching of the longitudinal ends may occur while the packaging material 114 is stationary, or the sealing mechanism 124 may be configured to translate with the packaging material 114.

In some instances, a spacing between the first punches and the second punches may be adjustable to either increase or decrease a spacing between the first holes 132 and the second holes 134, respectively (e.g., in the Z-direction). Moreover, in some instances, the amount of punches actuated by the sealing mechanism 124 may be based on the width of the container 122 (e.g., in the Z-direction). After punching, the container 122 may be pushed onto or otherwise fed for further processing. For example, the container 122 may be sorted for shipment based on a destination address of the container 122.

The machine 102 may therefore be configured to retrieve items for packing, and to pack the items into custom sized containers. Given that the container 122 is punched together using portions of the packaging material 114 (e.g., the first tabs 136 and the second tabs), the container 122 may reduce waste and increase throughput by limiting the amount of time the presses are required to hold the packaging material 114 together during curing of the adhesive. Moreover, the machine 102 may improve packing quality, reduce a likelihood of item or container damage, and improve processing efficiencies.

Although a single machine is discussed, it is to be understood that the environment 100 may include any number of machines that process the item(s) for shipment. Any number of the machines are configured to operate independently and perform operations for processing the item(s) for shipment. Further, although FIG. 1 illustrates the container 122 being formed around a single item (e.g., the item 106), more than one item may be disposed on the packaging material 114 at a time to increase throughput of the machine 102.

Figure 2:
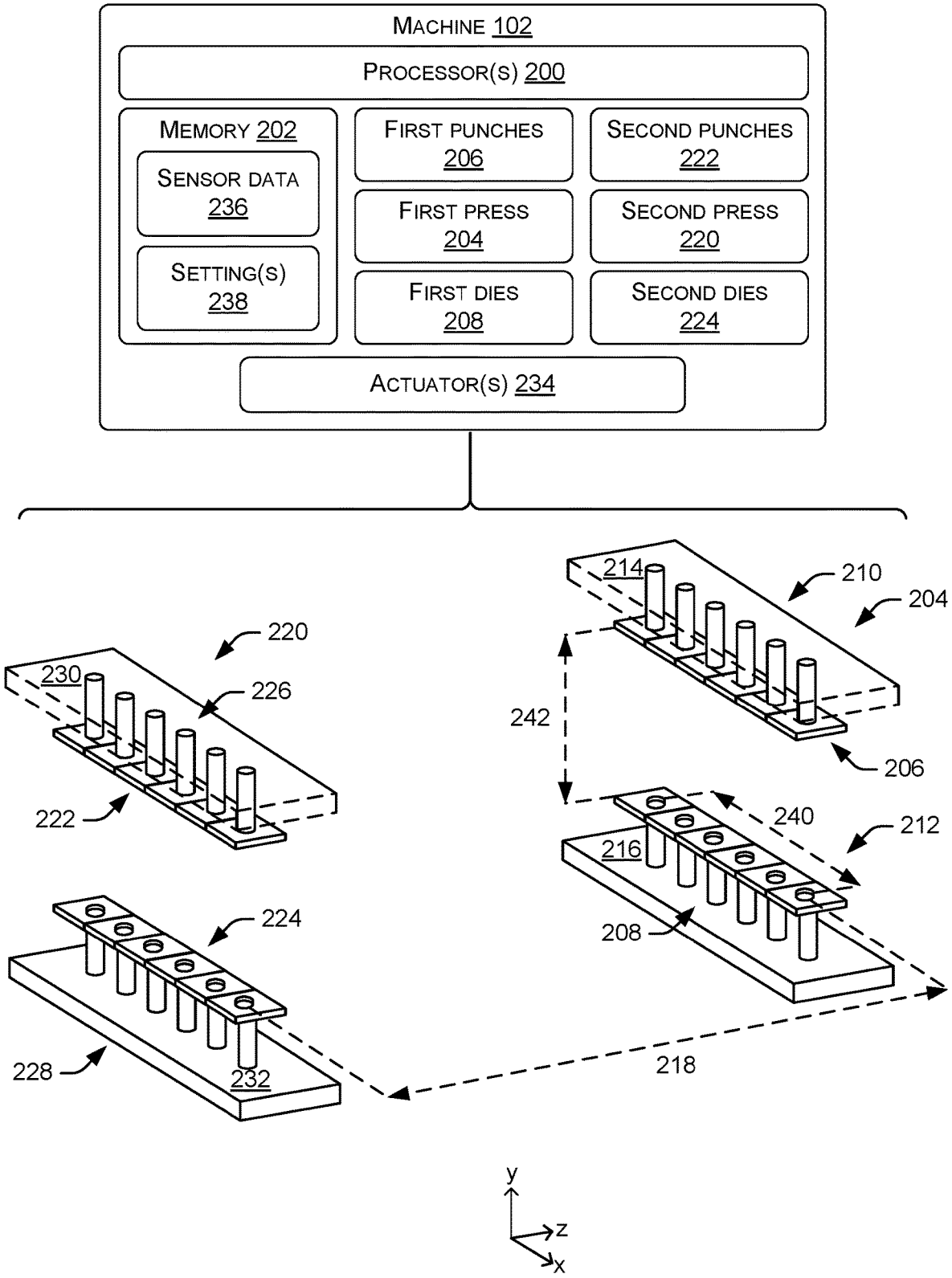
FIG. 2 illustrates select components of the machine and/or the sealing mechanism of FIG. 1, according to examples of the present disclosure.

FIG. 2 illustrates example components of the machine 102. The machine 102 is shown including processor(s) 200 and memory 202, where the processor(s) 200 may perform various functions and operations associated with sealing the container 122, and the memory 202 may store instructions executable by the processor(s) 200 to perform the operations described herein.

The machine 102 includes a first press 204 having first punches 206 and first dies 208 for forming the first tabs 136 and sealing the container 122 at the first longitudinal end 128, for example. In some instances, the first press 204 may include a first upper press 210 and a first lower press 212. The first upper press 210 may include the first punches 206, while the first lower press 212 may include the first dies 208. In some instances, the first punches 206 may couple to or be disposed on a first upper platform 214 of the first upper press 210, while the first dies 208 may couple to or be disposed on a first lower platform 216 of the first lower press 212. Portions of the first upper platform 214 are shown in dashed lines to illustrate the first punches 206. As shown, the first punches 206 and the first dies 208 may extend from the first upper platform 214 and the first lower platform 216, respectively, to engage with one another during a sealing of the container 122. The first dies 208 may be complimentary to receive a corresponding portion of the first punches 206, respectively, for example, a tip of the first punches 206. As such, as the first press 204 is brought together (e.g., in the y-direction), the first press 204 presses portions of the packaging material 114 together while the first punches 206 and the first dies 208 create the first tabs 136 to seal the container 122.

Additionally, the machine 102 includes a second press 220 having second punches 222 and second dies 224 for forming the second tabs 138 and sealing the container 122 at the second longitudinal end 130, for example. In some instances, the second press 220 may include a second upper press 226 and a second lower press 228. The second upper press 226 may include the second punches 222, while the second lower press 228 may include the second dies 224. In some instances, the first punches 206 may couple to or be disposed on a second upper platform 230 of the second upper press 226, while the second dies 224 may couple to or be disposed on a second lower platform 232 of the second lower press 228. Portions of the second upper platform 230 are shown in dashed lines to illustrate the second punches 222. As shown, the second punches 222 and the second dies 224 may extend from the second upper platform 230 and the second lower platform 232, respectively, to engage with one another during a sealing of the container 122. The second dies 224 may be complimentary to receive a corresponding portion of the second punches 222, respectively, for example, a tip of the second punches 222. As such, as the second press 220 is brought together (e.g., in the y-direction), the second press 220 presses portions of the packaging material 114 together while the second punches 222 and the second dies 224 create the second tabs 138 to seal the container 122.

The machine 102 also includes actuator(s) 234 for actuating the first press 204, the first punches 206, the first dies 208, the second press 220, the second punches 222, and the second dies 224, respectively. In some instances, the actuator(s) 234 may independently actuate the first punches 206, the first press 204, the first dies 208, the second punches 222, the second press 220, and the second dies 224, respectively. Example actuator(s) 234 include linear cylinders, whether pneumatic or fluid, screw drives, motors, and so forth.

The actuator(s) 234 actuate the first punches 206 and the second punches 222 for forming the first holes 132 and the second holes 134 through the packaging material 114. Additionally, actuating the first punches 206 and the second punches 222 creates the first tabs 136 and the second tabs 138, respectively. In some instances, the first punches 206 and the second punches 222 are actuated substantially simultaneously, or may be actuated at different times.

In some instances, the machine 102 (or the sealing mechanism 124) may include six first punches 206, six first dies 208, six second punches 222, and six second dies 224. However, although six first punches 206, six first dies 208, six second punches 222, and six second dies 224 are shown, the machine 102 may include more than or less than six first punches 206, six first dies 208, six second punches 222, and/or six second dies 224 (e.g., four, five, seven, eight, ten, twelve, etc.). Moreover, in some instances, not all of the first punches 206, the first dies 208, the second punches 222, and the second dies 224 may be used to seal the container 122. For example, depending upon the width of the container 122 to be formed (e.g., in the x-direction), not all of the first punches 206, the first dies 208, the second punches 222, and the second dies 224 may be used. This may, in some instances, include not actuating certain ones of the first punches 206, the first dies 208, the second punches 222, and the second dies 224. Alternatively, all of the first punches 206, the first dies 208, the second punches 222, and the second dies 224 may be actuated, but only a portion of the first punches 206, the first dies 208, the second punches 222, and the second dies 224 may contact form the first tabs 136 and the second tabs 138, respectively. In such instances, on a portion of the first press 204 and the second press 220 may be engage with the packaging material 114 to press the longitudinal ends of the container 122 together.

The first punches 206 and the second punches 222 may be spaced apart by a longitudinal distance 218. The longitudinal distance 218 may also correspond to a spacing between the first dies 208 and the second dies 224. In some instances, the longitudinal distance 218 is disposed along a length of the container 122 (e.g., in the Z-direction). In some instances, the longitudinal distance 218 may be in the range of about four inches (+/−¼ inches) to about seventy-two inches (+/−¼ inches). However, other dimensions are envisioned.

In some instances, the first press 204 (as well as the first punches 206 and the first dies 208) and/or the second press 220 (as well as the second punches 222 and the second dies 224) may translate in the Z-direction and based on the length of the container 122. For example, the memory 202 is shown including sensor data 236, which may be received via the sensor(s) 112 that measure the dimensions of the item 106. Based at least in part on the sensor data 236, the machine 102 (or another communicatively coupled computing device), may determine the dimensions of the item 106. This may, in turn, be used to determine setting(s) 238 of the machine 102, for example, the longitudinal distance 218. As such, after determining a length of the item 106, the first press 204 and/or the second press 220 may translate to reposition the first punches 206, the first dies 208, the second punches 222, and the second dies 224, respectively, in order to form the container 122. Such translation may occur via the actuator(s) 234. Additionally, in some instances, the first upper platform 214, the first lower platform 216, the second upper platform 230, and/or the second lower platform 232 may be disposed on a system of tracks, rails, slides, and so forth for adjusting their longitudinal position.

The first punches 206 and the first dies 208, as well as the second punches 222 and the second dies 224, may be spaced apart by a vertical distance 242. For example, the first punches 206 and the first dies 208 may be separated from one another by the vertical distance 242, and/or the second punches 222 and the second dies 224 may be separated from one another by the vertical distance 242. In some instances, the vertical distance 242 represents a spacing prior to the container 122 entering the sealing mechanism 124. In this manner, the spacing may allow the container 122 to pass within, or enter, the sealing mechanism 124 such that the longitudinal ends may be sealed. In some instances, the first upper platform 214 and/or the second upper platform 230 are disposed on a system of tracks, rails, slides, and so forth for adjusting their vertical position. For example, once the container 122 enters the sealing mechanism 124, the first upper platform 214 and the second upper platform 230 may descend upon the longitudinal ends of the container 122. After sealing, the first upper platform 214 and the second upper platform 230 may retract such that the container 122 is permitted to leave the sealing mechanism 124. Additionally, or alternatively, the first lower platform 216 and/or the second lower platform 232 may function in a similar manner. In some instances, the vertical distance 242 may be up to about forty eight inches (+/−¼ inches). However, other dimensions are envisioned and the sealing mechanism 124 may be positioned based on a height of the item 106 (as determined via the sensor data 236 and/or the setting(s) 238).

The first punches 206, the first dies 208, the second punches 222, and/or the second dies 224 may also span a lateral length 240. Individual punches and dies of the first punches 206, the first dies 208, the second punches 222, and/or the second dies 224, respectively, may be spaced apart from one another along the lateral length 240. For example, the six first punches 206 may be disposed along the lateral length 240. In some instances, the lateral length 240 may be up to about forty eight inches (+/−¼ inches). In such instances, and as noted above, more than six first punches 206, six first dies 208, six second punches 222, and six second dies 224 may be included. That is, the sealing mechanism 124 may be configured to seal containers 122 have a width of up to approximately forty eight inches wide. Moreover, as noted above, depending upon the width of the container 122, certain ones of the first punches 206, the first dies 208, the second punches 222, and/or the six second dies 224 may nor may not be used. Such determinations may be made using the sensor data 236 and implemented using the setting(s) 238 to control the first punches 206, the first dies 208, the second punches 222, and/or the second dies 224 (e.g., via the actuator(s) 234).

Although the machine 102 is shown including certain components, other components may be included to effectuate operation of the first punches 206, the first dies 208, the second punches 222, and/or the second dies 224, the actuator(s) 234, and so forth. For example, the machine 102 (or the sealing mechanism 124 of the machine 102), may include other frames, brackets, mounts, and so forth in addition to or alternative from those shown. Further, such components may couple to one another to effectuate their operation and to seal the container 122 as described herein. Moreover, although not shown, the machine 102 may couple to remote computing resource(s) that may, in some instances, control at least part of the operation of the machine 102 (e.g., determining dimensions of the item 106).

Still, the machine 102 may include other features for folding, forming, and creating the container 122, such as those described in, for example, U.S. patent application Ser. No. 16/871,767, filed May 11, 2020, entitled "Roll-Formed Containers for Shipping," the entirety of which is herein incorporate by reference for all purposes.

As used herein, a processor, such as the processor(s) 200, may include multiple processors and/or a processor having multiple cores. Further, the processor(s) may comprise one or more cores of different types. For example, the processor(s) may include application processor units, graphic processing units, and so forth. In one implementation, the processor(s) may comprise a microcontroller and/or a microprocessor. The processor(s) may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) may possess its own local memory, which also may store program components, program data, and/or one or more operating systems.

Memory, such as the memory 202, may include volatile and nonvolatile memory, removable and non-removable media implemented in any method or technology for storage of information, such as computer-readable instructions, data structures, program component, or other data. Such memory may include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory may be implemented as computer-readable storage media ("CRSM"), which may be any available physical media accessible by the processor(s) to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s).

Figure 3A:
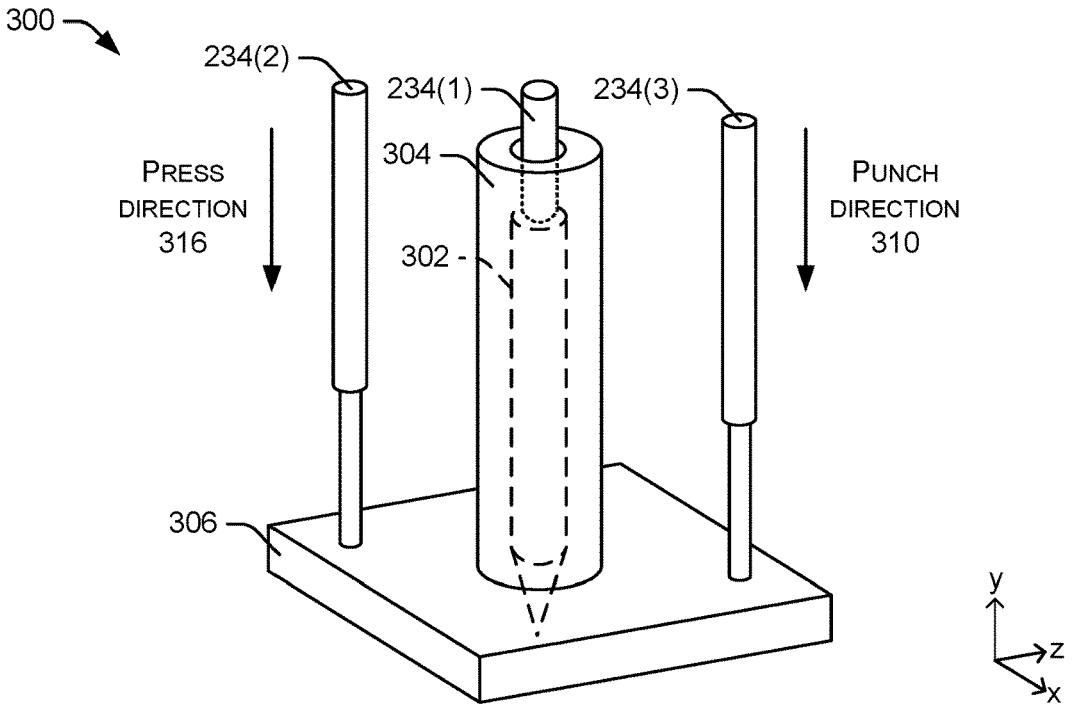
FIGS. 3A and 3B illustrate an example press and an example punch of the sealing mechanism of FIG. 1, according to examples of the present disclosure.
Figure 3B:
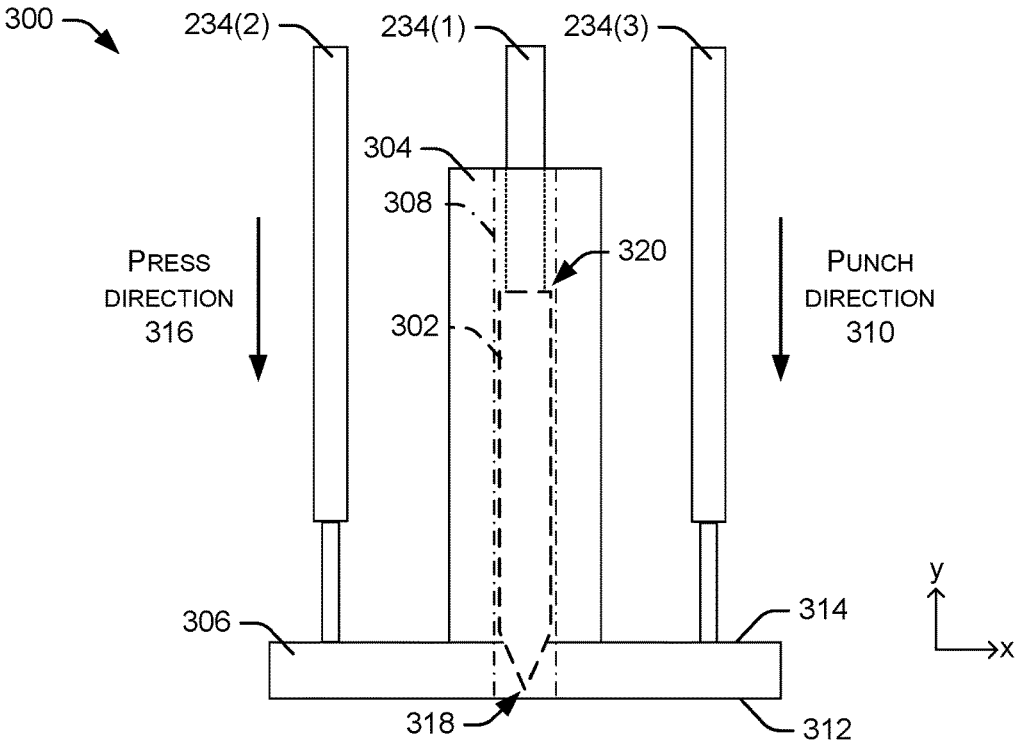

FIGS. 3A and 3B illustrate an example press 300 including a punch 302. In some instances, the punch 302 is representative of individual punches of the first punches 206 and/or the second punches 222, while the press 300 is representative of individual presses of the first upper press 210 and/or the second upper press 226.

The punch 302 may be disposed within a housing 304 that couples to a plate 306 of the press 300. The housing 304 may include or define a passageway 308 within which the punch 302 translates. For example, a first actuator 234(1) (e.g., among the actuator(s) 234) may couple to the punch 302 to extend the punch 302 from and retract the punch 302 within the housing 304. As such, the first actuator 234(1) as well as the punch 302 are able to translate in a punch direction 310 (e.g., y-direction) during a sealing of the container 122 to form holes and tabs. For example, the punch 302 may extend through the plate 306 to punch through the packaging material 114. Corresponding openings in the housing 304 and the plate 306 allow the punch 302 to extend from the housing 304 and/or the plate 306 (e.g., a bottom surface 312 of the plate 306) and engage the packaging material 114.

A second actuator 234(2) and a third actuator 234(3) may couple to the plate 306 (e.g., a top surface 314) to press the plate 306 into contact with the packaging material 114. For example, the second actuator 234(2) and the third actuator 234(3) may extend the plate 306 in a press direction 316 (e.g., y-direction). While the plate 306 extends in the press direction 316, the housing 304, the first actuator 234(1), and the punch 302 may correspondingly move. For example, the first actuator 234(1), the second actuator 234(2), and/or the third actuator 234(3) may include a synchronized actuation. The plate 306, or the bottom surface 312 of the plate 306, is configured to engage with the packaging material 114 and compress the packaging material 114 against a complimentary plate (e.g., a plate associated with the first lower press 212 and the second lower press 228).

Opposite ends of the first actuator 234(1) not coupled to the punch 302, as well as opposites ends of the second actuator 234(2) and the third actuator 234(3) not coupled to the plate 306, may couple to a platform (e.g., the first upper platform 214, the second upper platform 230, etc.). In some instances, the passageway 308 may include or be lined with bushings, bearings, and the like to assist in the translation of the punch 302.

The punch 302 is shown including a first end 318 and a second end 320. The first end 318 may represent a piercing end of the punch 302 that pierces into/through the packaging material 114 the first end 318 may include different shapes and contours for forming the first tabs 136 and the second tabs 138. The second end 320 may represent a trailing end of the punch 302, opposite the first end 318. The punch 302 includes a length that extends between the first end 318 and the second end 320. In some instances, the punch 302 may taper outwards, towards a central axis of the punch 302, from the first end 318 and the second end 320. For example, the first end 318 (or adjacent the first end 318) may include a first cross-sectional dimension, while the second end 320 (or adjacent the second end 320) may include a second cross-sectional dimension that is larger than the first cross-sectional dimension. This tapering may assist in the punch 302 retreating from the packaging material 114 and/or the hole formed within the packaging material 114 to avoid the punch 302 catching on sidewalls of the hole.

The first end 318 includes a profile for piercing through the packaging material 114. In some instances, the first end 318 may include a conical shape. However, other shapes are envisioned. For example, the first end may include a square shape, a cylindrical shape, a rectangular shape, and so forth. The shape of the first end 318 may assist in forming tabs of the packaging material 114 (e.g., the first tabs 136 and the second tabs) that are used to secure the longitudinal ends of the container 122 together. For example, as the first end 318 pierces through the packaging material 114, the shape of the first end 318 may form the tabs that are then used to secure the longitudinal ends of the container 122 during pressing.

In some instances, the plate 306 and/or the housing 304 may include different shapes than shown. For example, the plate 306 may include other shapes (e.g., circular, hexagonal, etc.). In some instances, the housing 304 and/or the plate 306 may be formed of a single piece of material, or may be coupled to one another.

Figure 4A:
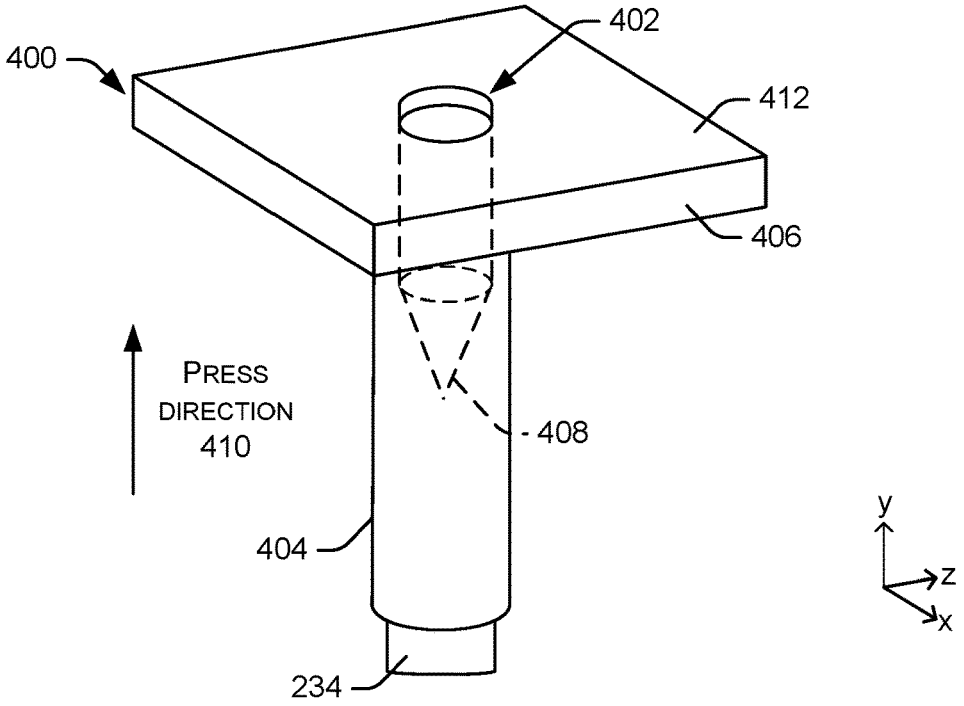
FIGS. 4A and 4B illustrate an example press and an example die of the sealing mechanism of FIG. 1, according to examples of the present disclosure.
Figure 4B:
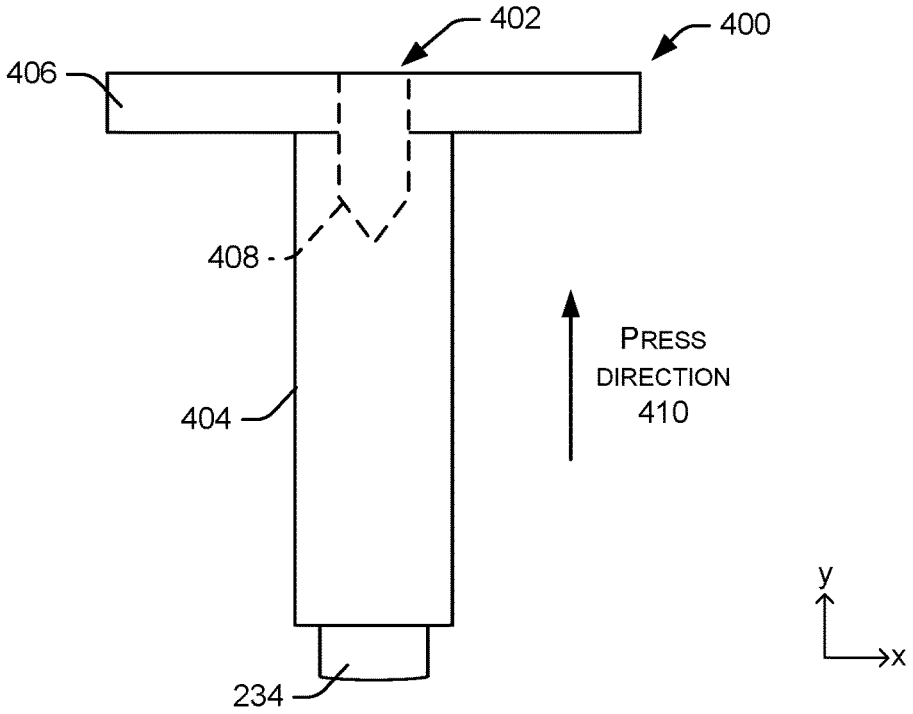

FIGS. 4A and 4B illustrate an example press 400 including an example die 402. In some instances, the die 402 is representative of individual dies of the first dies 208 and/or the second dies 224, while the press 400 is representative of individual presses of the first lower press 212 and/or the second lower press 228.

The die 402 may be disposed with a housing 404 that couples to a plate 406 of the press 400. The housing 404 may include or define the die 402. As shown, the die 402 may represent a channel or other cavity formed within the housing 404 and/or the plate 406. The die 402 is complimentary to receive a punch, such as the punch 302, and accordingly, may include shapes and/or contours that are complimentary to the punch 302. For example, a bottom 408 of the die 402 is shown including a conical feature for receiving a conically-shaped tip of the punch 302 (e.g., in instances where a tip of the punch 302 includes a conical shape). As such, the die 402 may receive the punch 302 (or a portion thereof) such that the punch 302 nests within the die 402. In instances where the end of the punch 302 includes different shapes and/or contours, the die 402 may include corresponding shapes and contours as well. For example, the die 402 may be square, hexagonal, circular, and so forth. Additionally, the bottom 408 may be complimentary to receive a plurality of differently shaped tips of the punch 302.

An actuator 234 (e.g., of the actuators 234) may couple to the housing 404 to press the plate 406 into contact with the packaging material 114 and advance the die 402 (as well as the plate 406) in a direction towards the press 300. For example, the actuator 234 may extend the plate 406 in a press direction 410 (e.g., y-direction) that is opposite the press direction 316 and/or the punch direction 310. While the plate 406 extends in the press direction 410, the housing 404 and the die 402 may correspondingly move. The plate 406, or a top surface 412 of the plate 406, is configured to engage with the packaging material 114 and compress the packaging material 114 against a complimentary plate (e.g., the plate 306 associated with the press 300). In doing so, the packaging material 114 may be compressed between the plates. Additionally during this occurrence, the punch 302 is received with the die 402.

Although the die 402 is shown including a particular depth (e.g., in the Y-direction), different depths are envisioned. For example, the depth of the die 402 may be such that the die 402 may receive more than or less than a portion of the length of the punch 302. Additionally, the actuator 234 may couple to the plate 406 (e.g., a bottom surface), in addition to or alternative from the housing 404. In some instances, the housing 404 and/or the plate 406 may be formed of a single piece of material, or may be coupled to one another.

Figure 5A:
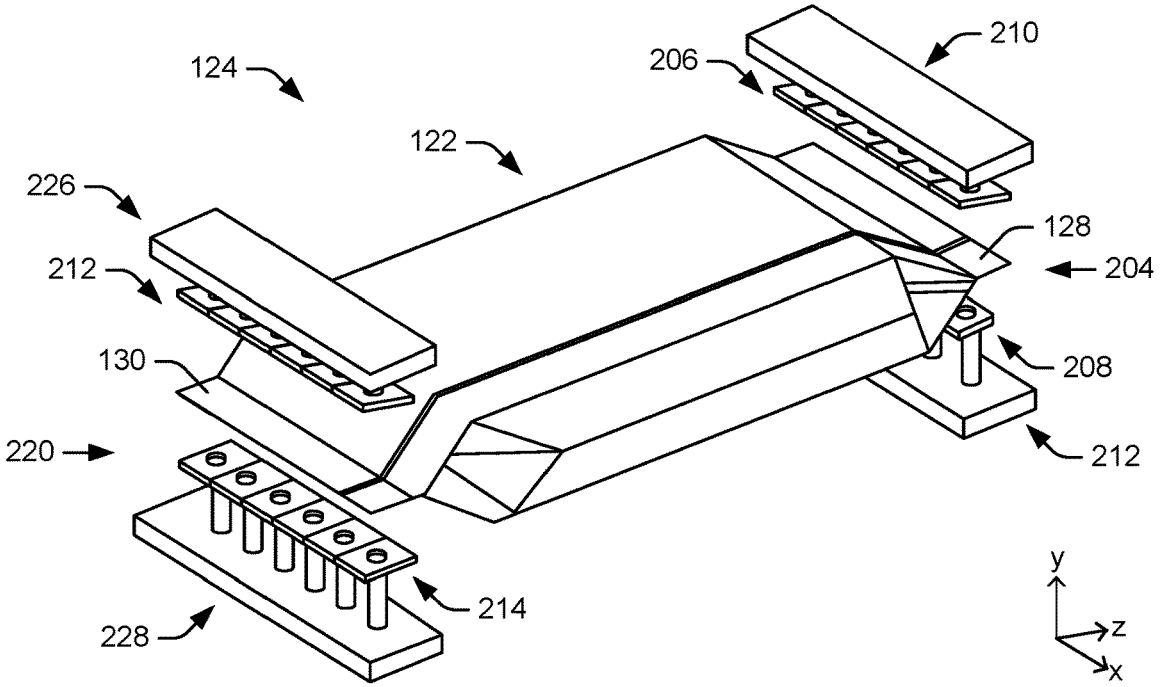
FIGS. 5A-5C illustrate an example process for sealing a container using the sealing mechanism of FIG. 1, according to examples of the present disclosure.
Figure 5B:
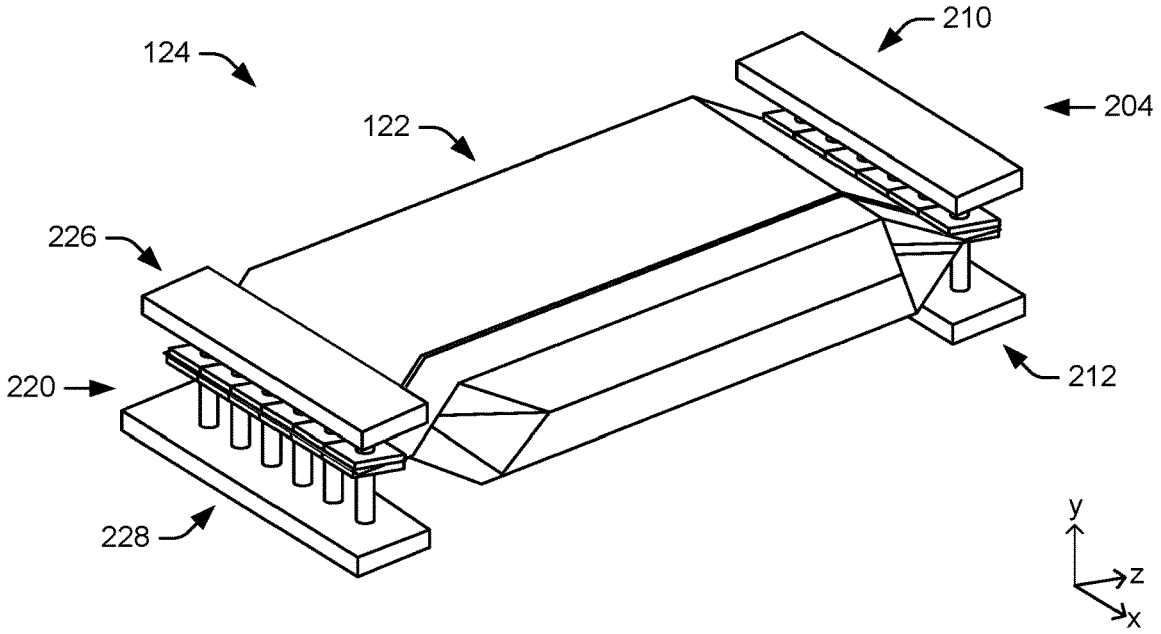
Figure 5C:
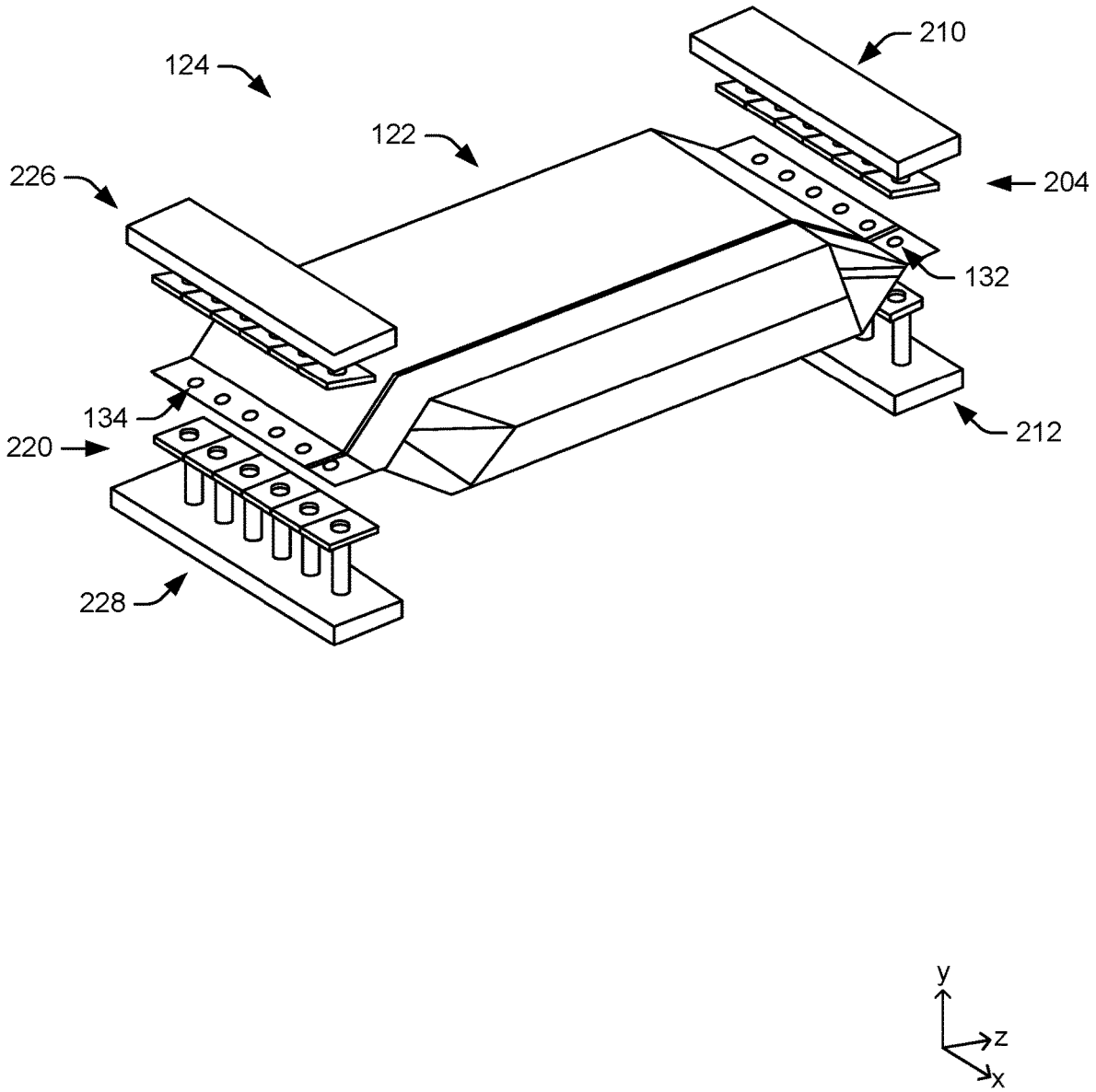

FIGS. 5A-5C illustrate a progression of illustrations for securing seams of the container 122 using the sealing mechanism 124, for example.

In FIG. 5A, the first press 204 and the second press 220 are shown being separated (e.g., in y-direction) such that the sealing mechanism 124 may receive the container 122. More particularly, the first punches 206 may be spaced apart from the first dies 208, and the second punches 222 may be spaced apart from the second dies 224. The first punches 206 and the first dies 208 are arranged to enclose the first longitudinal end 128 of the container 122 via actuation of the first upper press 210 and the first lower press 212. The second punches 222 and the second dies 224 are arranged to enclose the second longitudinal end 130 of the container 122 via actuation of the second upper press 226 and the second lower press 228. In FIG. 5A, the container 122 may represent a tube-like structure formed via folding the packaging material 114, but with the first longitudinal end 128 and the second longitudinal end 130 yet to be secured.

In FIG. 5B, the first press 204 and the second press 220 are shown being brought together to compress the packaging material 114 at the first longitudinal end 128 and the second longitudinal end 130, respectively. During this instance, the first punches 206 form the first holes 132 and the first tabs 136, and the first dies 208 receive the first punches 206, respectively. Additionally, the second punches 222 form the second holes 134 and the second tabs 138, and the second dies 224 receive the second punches 222, respectively. Shortly thereafter, the first tabs 136 are compressed via plates of the first upper press 210 and the first lower press 212. Additionally, the second tabs 136 are compressed via plates via the second upper press 226 and the second lower press 228.

In FIG. 5C, the first press 204 and the second press 220 are shown being separated (e.g., in y-direction) such that the container 122 may be released from the sealing mechanism 124. More particularly, the first punches 206 may be spaced apart from the first dies 208, and the second punches 222 may be spaced apart from the second dies 224, to allow the container 122 (now sealed) to be processed for further manufacturing. The first holes 132 and the first tabs 136 (underneath side) may be formed at the first longitudinal end 128, while the second holes 134 and the second tabs 138 (underneath side) may be formed at the second longitudinal end 130.

Although the first press 204 and the second press 220 are shown including a certain number of punches and dies, respectively, more punches and dies may be included. In some instances, not all of the punches and/or dies may be used when securing the container 122 at the first longitudinal end 128 and the second longitudinal end 130. For example, the punches and/or dies may extend beyond lateral edges of the container 122, for securing containers having a width greater than that shown in FIGS. 5A-5C. Additionally, the positioning of the first punches 206, the first dies 208, the second punches 222, the second dies 224 may be determined and/or set prior to the container 122 arriving at the sealing mechanism 124 in order to properly form the container 122 according to the dimensions of the item 106. Such movement may be accomplished by moving the first upper press 210 and the first lower press 212, the second upper press 226, and the second lower press 228.

The sealing mechanism 124 may include components different than those described and illustrated. For example, in some instances, the sealing mechanism 124 may include punches that form the tabs from the packaging material 114, as well as a hole spaced apart from the tab formed by the packaging material 114. The sealing mechanism 124 may include levers that respectively feed the tabs through the hole in order to bind the packaging material 114 together, such as in the case of stapleless staplers. For example, after the punches form the hole and the tab, the lever may insert (e.g., push) the free end of the tab (e.g., not connected to the packaging material 114) into the hole. During this process and while the tabs are being fed through the holes, the packaging material may be pressed together via the press in order to prevent separation of the ends of the container 122. In these instances, the tabs may include an arrow-shape, spade-shape, T-shape, and so forth. However, the tabs may include wings or other tabs that are insertable into the previously cut hole and which prevent the tabs from backing out of the hole.

Figure 6:
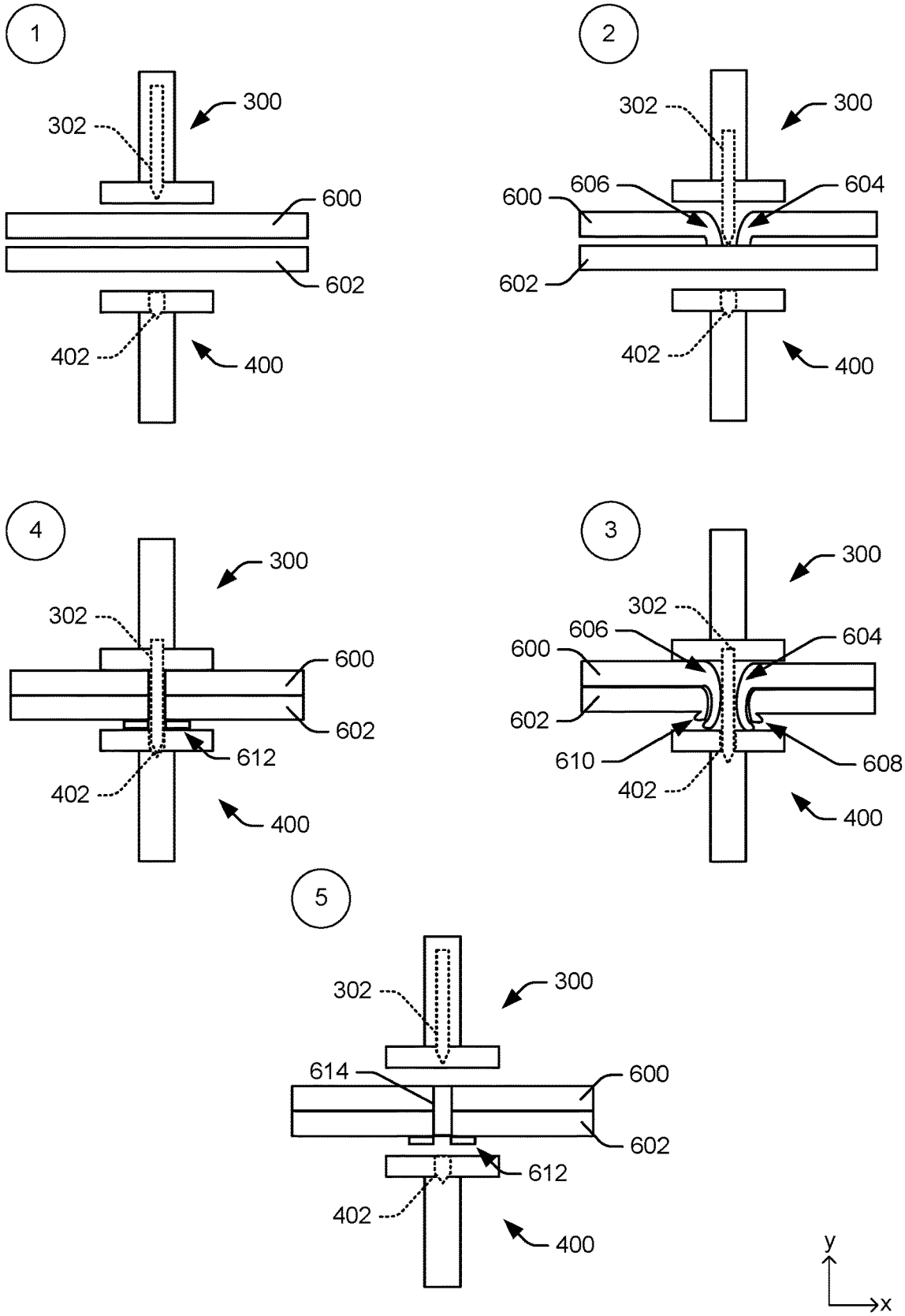
FIG. 6 illustrates an example flow of operations for sealing a container using the sealing mechanism of FIG. 1, according to examples of the present disclosure.

FIG. 6 illustrates a progression of steps to secure the packaging material 114, whether at the first longitudinal end 128 or the second longitudinal end 130. The illustrations in FIG. 6 are simplified to more clearly illustrate the operation of the presses, and specifically, the punches and the dies. For example, the actuators 234 are omitted for clarity. However, it is to be understood that the punches and the dies may operate in accordance with the description herein.

At "1," the press 300 (e.g., a press of the first upper press 210) and the press 400 (e.g., a press of the first lower press 212) are shown being separated and/or spaced apart from one another. The packaging material 114 is disposed between the press 300 and the press 400, as well as the punch 302 and the die 402. The packaging material 114 shown is merely exemplary, and differently shaped, sized, etc. pieces of the packaging material 114 may be disposed between the press 300 and the press 400. Additionally, more layers of the packaging material 114 may be disposed between the press 300 and the press 400 than shown (e.g., three, four, etc.). As shown, the packaging material 114 includes a first piece 600 and a second piece 602. The first piece 600 and the second piece 602 may be formed from the same piece of packaging material 114, but at the longitudinal ends of the container 122, the packaging material 114 may overlap. At "1" the first piece 600 and the second piece 602 are shown being spaced apart and not compressed by the press 300 and the press 400.

At "2," the punch 302 is actuated in a direction toward the first piece 600. In doing so, the punch 302 pierces through the first piece 600, forming a hole through the first piece 600, as well as a first flap 604 and a second flap 606. The first flap 604 and the second flap 606 are formed from the first piece 600, and the first flap 604 and the second flap 606 may remain coupled to the first piece 600. However, the first flap 604 and the second flap 606 may be simultaneously pushed in a direction towards the second piece 602. More than two flaps, however, may be formed. In some instances, the tapering of the punch 302 may assist in pushing the first flap 604 and the second flap 606. For example, a body of the punch 302 may taper outward such that as the punch 302 is advanced downward, the first flap 604 and the second flap 606 are pushed by the punch 302.

At "3," the punch 302 may be further actuated. In doing so, the punch 302 pierces through the second piece 602, forming a hole through the second piece 602, as well as a third flap 608 and a fourth flap 610. The third flap 608 and the fourth flap 610 are formed from material of the second piece 602, and the third flap 608 and the fourth flap 610 may remain coupled to the second piece 602. However, the third flap 608 and the fourth flap 610 may be simultaneously pushed through the hole formed by the punch 302. Additionally, the first flap 604 and the second flap 606 are pushed through the second piece 602 (e.g., via the tapering of the punch 302).

As also shown, the first press 300 may press against the first piece 600, forcing the first piece 600 into contact with the second piece 602. The tip of the punch 302 (e.g., the first end 318) is also shown being received with the die 402, so as to seat or nest the punch 302 within the die 402.

At "4," the press 400 may be actuated in a direction towards the press 300, to compress the first piece 600 and the second piece 602 between the press 300 and the press 400. During this instance, the punch 302 may remain disposed through the first piece 600 and the second piece 602. Additionally, during compression of the first piece 600 and the second piece 602, the first flap 604, the second flap 606, the third flap 608, and/or the fourth flap 610 may fill a space around the punch 302. A tab 612 is shown being formed adjacent to the second piece 602, which may be formed at least in part by the first flap 604, the second flap 606, the third flap 608, and/or the fourth flap 610. In doing so, the first piece 600 and the second piece 602 are prevented from separating when the press 300 and the press 400 release. That is, by forming the tab 612 from the first flap 604, the second flap 606, the third flap 608, and/or the fourth flap 610, the first piece 600 and the second piece 602 resist separation when the press 300 and the press 400 release. Further, the compression imparted by the press 300 and the press 400 may prevent the tab 612 unbinding.

In some instances, both the press 300 and the press 400 may be actuated to compress the packaging material 114. In other instances, one of the press 300 or the press 400 may be actuated in a direction towards one another to compress the packaging material 114. In some instances, as the press 300 moves in the press direction 316, the punch 302 may at least partially retract into the press 300. For example, a pressing force of the press 400 may cause the first actuator 234(1) coupled to the punch 302 to compress, thereby retracting the punch 302 at least partially back into the press 300 (or the housing 304). However, in some instances, the punch 302 may remain disposed through the first piece 600 and the second piece 602.

Although the tab 612 is shown being disposed adjacent to the second piece 602, tabs may additionally or alternatively be disposed adjacent to the first piece 600. For example, an orientation of the press 300 and the press 400 may be switched. Additionally, or alternatively, a portion of the second piece 602 may be pulled back through the hole formed by the punch 302 and disposed adjacent to the first piece 600. Thereafter, the press 300 and the press 400 may be actuated to compress the first piece 600 and the second piece 602 to form tabs adjacent to the first piece 600 and the second piece 602, respectively.

At "5," the press 300 and the press 400 are shown being separated and/or spaced apart from one another after the first piece 600 and the second piece 602 are secured together via the tab 612. That is, as the tab 612 is at least partially formed via pieces of the first piece 600 (e.g., the first flap 604 and the second flap 606), the tab 612 is prevented being pulled through a hole formed by the punch 302, and therefore, separation of the press 300 and the press 400 is prevented. A hole 614 is shown extending through the first piece 600 and the second piece 602.

Although certain operations are shown being performed at certain instance in time, or in relation to one another, other embodiments are envisioned. For example, the packaging material 114 at the first longitudinal end 128 may be pressed together and held in place via adhesive. Thereafter, the punch may actuate to form the tabs to hold the packaging material 114 together while the container 122 is removed from the sealing mechanism 124 and while the adhesive is curing.

In some instances, the first piece 600 and the second piece 602 are single-sided corrugate, which enables the first flap 604, the second flap 606, the third flap 608, and the forth flap 610 to be formed without ripping. That is, given the material of the first piece 600 and the second piece 602, the first flap 604, the second flap 606, the third flap 608, and the forth flap 610 are formed via the punch 302 but remain connected to the first piece 600 and the second piece 602, respectively. The single-sided corrugate prevents the first piece 600 and the second piece 602 ripping during actuation of the punch 302. In doing so, the tabs 612 are formed and prevent separation of the first piece 600 and the second piece 602.

In some instances, the plate of the press 400 may include features for directing the first flap 604, the second flap 606, the third flap 608, and the forth flap 610 outwards, away from the punch 302. For example, a surface of the plate may include concave recessed features (e.g., dimples) that directs the first flap 604, the second flap 606, the third flap 608, and the forth flap 610 in a direction outwards. Alternatively, the surface of the plate may include extrusions that direct the first flap 604, the second flap 606, the third flap 608, and the forth flap 610 outwards. Regardless of the specific embodiment, the features may help direct the first flap 604, the second flap 606, the third flap 608, and the forth flap 610 outwards for forming the tab 612.

FIGS. 7A-7D illustrate a progression of depictions for securing the container 122, for example, using the sealing mechanism 124.

Figure 7A:
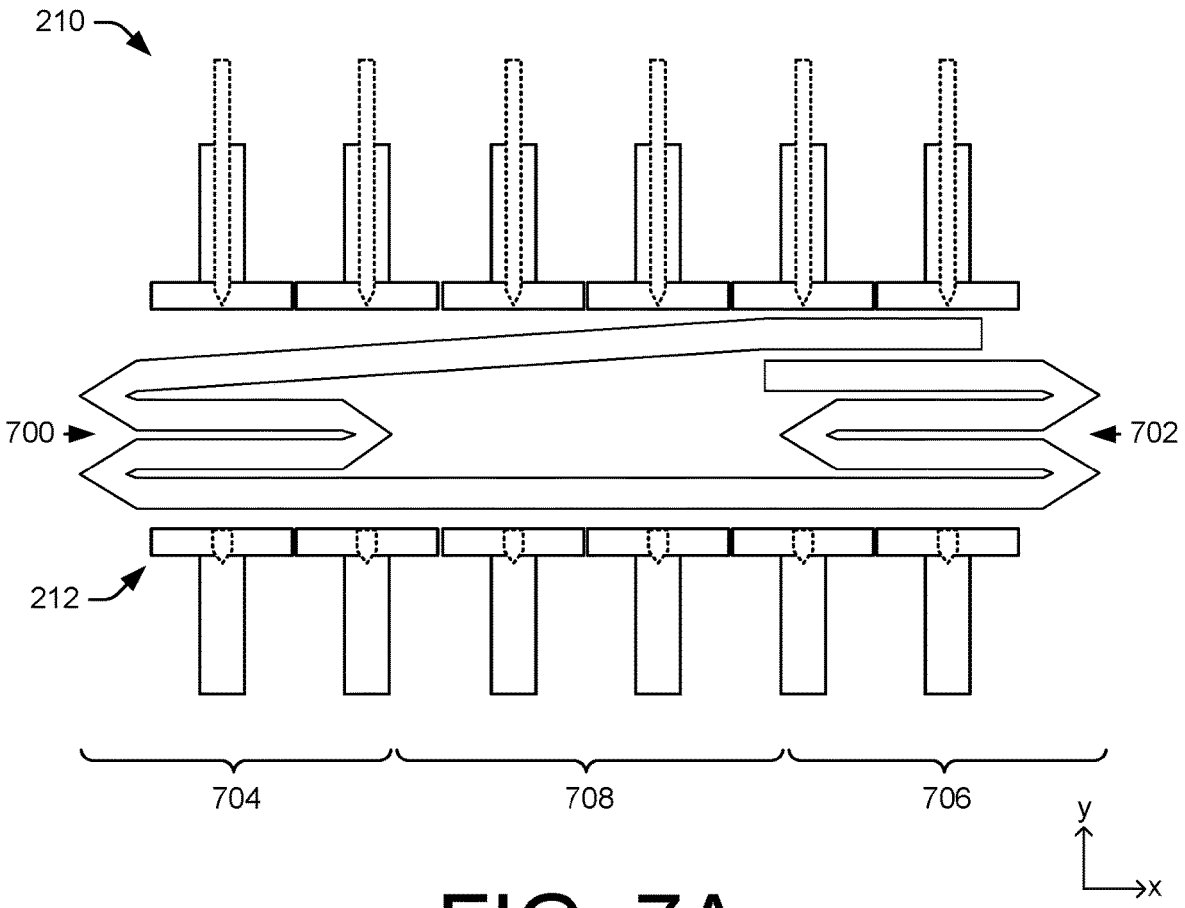
FIGS. 7A-7D illustrate an example process for sealing a container using the sealing mechanism of FIG. 1, according to examples of the present disclosure.

Beginning with FIG. 7A, an end view of the container 122 is shown. For example, the end view may represent the first longitudinal end 128 disposed between the first upper press 210 and the first lower press 212. At the first longitudinal end 128, the first press 204, such as the first upper press 210 and the first lower press 212 may seal different thickness of the packaging material 114. For example, along a first side 700 and a second side 702 of the container 122, at the first longitudinal end 128, the packaging material 114 may be folded upon itself to create gussets. This results in overlapping of the packaging material 114. For example, along a first portion 704 at the first side 700 and/or at the first longitudinal end 128, four layers of the packaging material 114 may be folded upon themselves. The second side 702 may include five layers of the packaging material 114, which may result from the seam created along a top of the container 122. The five layers may be disposed along a second portion 706 at the second side 702 and/or at the first longitudinal end 128. The second portion 706 is also shown including four layers where the seam does not reside. In some instances, the folding of the sides, as well as the seam along the top of the container 122, may be formed by the machine 102 at previous stations. A third portion 708, between the first side 700 and the second side 702, or between the first portion 704 and the second portion 706, includes two layers of the packaging material 114. As such, at the first longitudinal end 128, different thicknesses of the packaging material 114 may be present.

The first upper press 210 and the first lower press 212 include the first punches 206 and the first dies 208, respectively. As shown, individual punches of the first punches 206 may be aligned with individual dies of the first dies 208. The first punches 206 and the first dies 208 are independently actuatable to secure respective portions of the packaging material 114 at the first longitudinal end 128. For example, as will be explained herein, the first upper press 210 and the first lower press 212 are actuatable to compress these different thicknesses of the packaging material 114 and to secure the first longitudinal end 128 of the container 122. The individual presses of the first upper press 210 and the first lower press 212 are configured to be actuated from different amounts relative to the first upper platform 214 and the first lower platform 216.

Figure 7B:
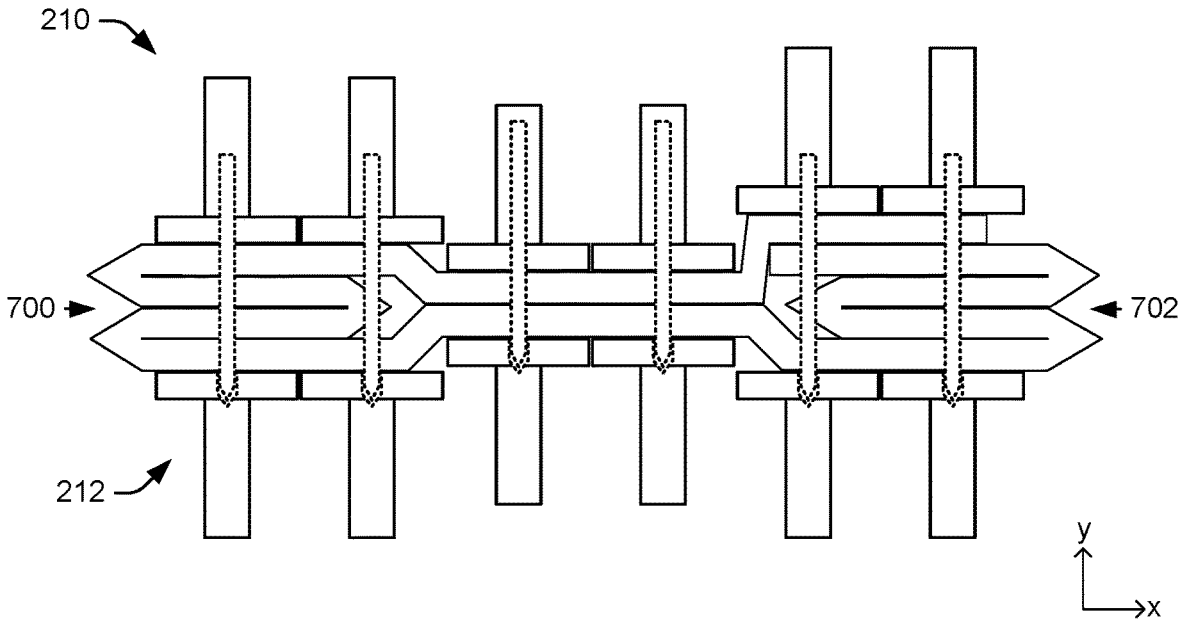

In FIG. 7B, the first upper press 210 and the first lower press 212 are shown compressing the packaging material 114 at the first longitudinal end 128. This involves, as explained above in FIG. 6, for example, the first punches 206 to punch through the packaging material 114 and engage with the first dies 208. Moreover, the first upper press 210 and the first lower press 212 translate in their respective press directions to compress the packaging material 114 together. Given the different thicknesses of the packaging material 114 at the first longitudinal end 128, the individual presses of the first upper press 210 and the first lower press 212 may compress the packaging material 114 by different amounts. For example, along the first portion 704, the first upper press 210 and the first lower press 212 may compress the four layers of the packaging material 114, along the second portion 706, the first upper press 210 and the first lower press 212 may compress the five layers of the packaging material 114, and along the third portion 708, the first upper press 210 and the first lower press 212 may compress the two layers of the packaging material 114. However, although a particular number of layers are shown, the sealing mechanism 124 may be used to a different number of layers, or overlapping layers, than shown (e.g., three, six, etc.).

In some instances, the first upper press 210 and the first lower press 212 may be configured to compress to a certain pressure (e.g., PSI). For example, a sensor may indicate the amount of pressure exerted by the first upper press 210 and the first lower press 212, and such pressure may be used to control a pressing force of the first upper press 210 and the first lower press 212. As such, because of the different thicknesses, and amount of the packaging material 114 to be compressed, the individual presses of the first upper press 210 and the first lower press 212 may not translate by the same amount.

The independent actuation of the presses of the first upper press 210 and the first lower press 212 permit increased sealing of the packaging material 114. For example, the first upper press 210 and the first lower press 212 are able to actuate by different amounts according to thickness of the packaging material 114. Conversely, if a single plate was used across the width of the container 122 at the first longitudinal end 128, portions of the packaging material 114 may not be adequately compressed together.

Figure 7C:
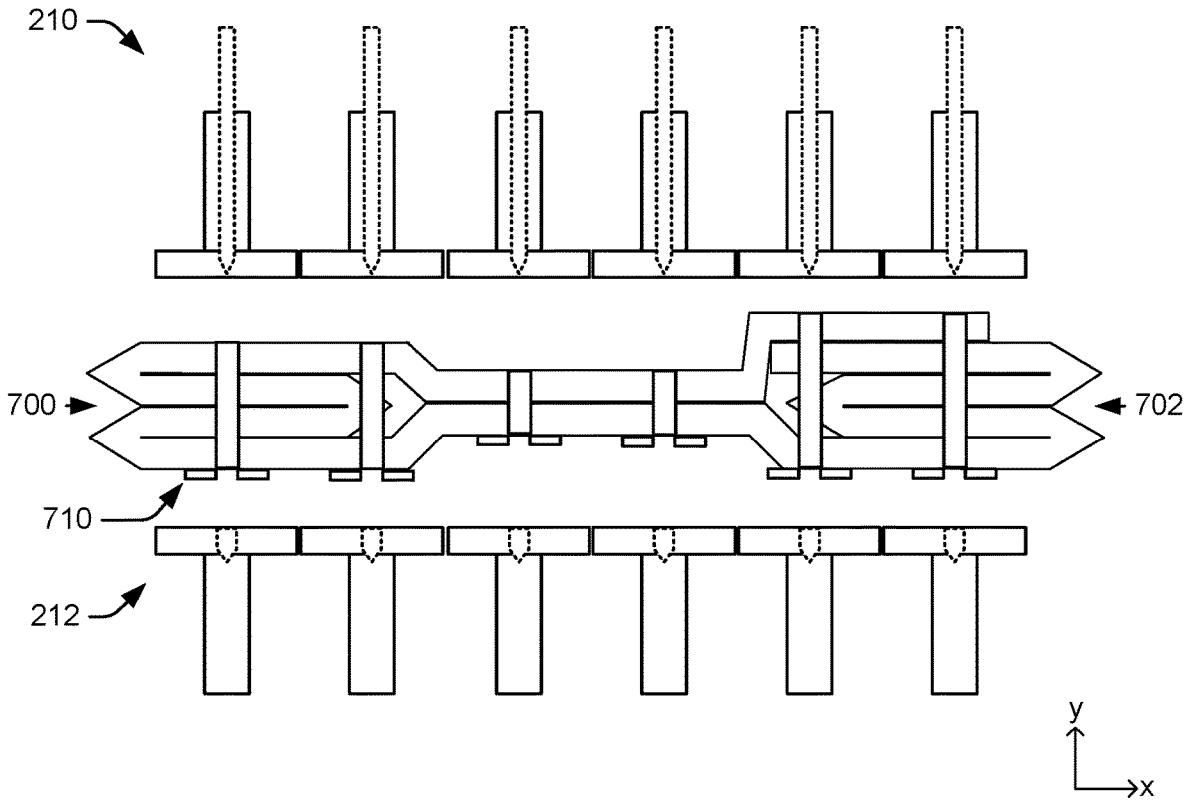

In FIG. 7C, the first upper press 210 and the first lower press 212 are shown being opened following actuation of the first upper press 210 and the first lower press 212. Along a bottom of the container 122, tabs 710 are shown being formed in order to prevent separation of the packaging material 114 and opening of the container 122. Each of the tabs 710 may be created by the respective packaging material 114 that the first punches form. That is, along the first portion 704, the tabs 710 be formed from the four layers of the packaging material 114, along the second portion 706, the tabs 710 be formed from the five layers of the packaging material 114, and along the third portion 708, the tabs 710 be formed from the two layers of the packaging material 114. The first punches 206 may include a sufficient stroke in order to pierce through the different layers of the packaging material 114. Additionally, following compression of the packaging material 114, a thickness of the packaging material 114 may be reduced.

Figure 7D:
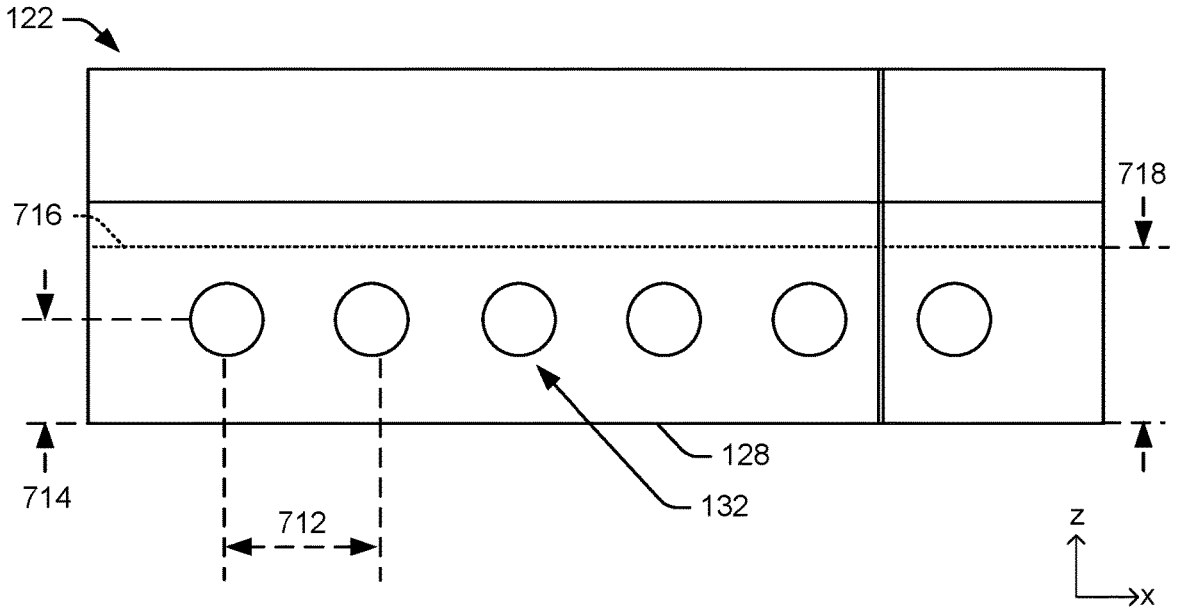

FIG. 7D illustrates a top view of the first longitudinal end 128 and after the first upper press 210 and the first lower press 212 form the first holes 132. The first holes 132 are shown being spaced apart by a distance 712. In some instances, the distance 712 may be between approximately five mm and twenty mm. That is, individual holes of the first holes 132 may be spaced apart between approximately five mm (e.g., +/−¼") and twenty mm (e.g., +/−¼"). In some instances, the first holes 132 may be evenly spaced apart from one another, or may be spaced apart from one another by different distances. In some instances, first punches 206 and the first dies 208 may be adjustable in one or more lateral directions (e.g., X-direction) to increase or decrease separation therebetween.

Although the container 122 is shown including a particular number of first holes 132 and a corresponding number of first tabs 136, the container 122 may include more than or less than the number of first holes 132 and first tabs 136 than shown. For example, the first upper press 210 and the first lower press 212 may include more than six first punches 206 and six first dies 208. In some instances, the number of first punches 206 and first dies 208 may not exceed eight per ten inches. This density may ensure an integrity of the container 122 as too many first holes 132 and first tabs 136 may create a weak point and result in a tearing of the packaging material 114. Here too, however, the creation of the first holes 132 may create a tear line that allows a consumer to open the container by tearing the packaging material 114 along a line disposed through the first holes 132. For example, the consumer may grip an end of the packaging material 114 and rip a piece of the packaging material 114 from the container 122 along a line disposed through or between the first holes 132. The first holes 132 may be equidistantly spaced along the line, and in some instances, the line may be substantially parallel to the first longitudinal end 128.

The first holes 132 are shown being spaced apart from the first longitudinal end 128 by a first depth 714. In some instances, the first depth 714 may be between approximately five mm (e.g., +/−¼") and twenty mm (e.g., +/−¼"). In some instances, the first holes 132 may even be formed along the first longitudinal end 128 (as shown and discussed in FIG. 12D). Still, although the first holes 132 are shown including a circular shape, other shapes are envisioned.

FIG. 7D further shows an adhesive 716 that is applied to the packaging material 114, which may be within an interior of the container 122 and prior to the packaging material 114 being folded to create the container 122. For example, the adhesive 716 may be applied to portions of the packaging material 114 that overlap and which are to be sealed upon one another. The adhesive 716 may be applied as a bead, line, drops, and so forth. In some instances, the adhesive 716 is spaced apart from the first longitudinal end 128 by a second depth 718. The second depth 718 may be greater than the first depth 714 such that the adhesive does not contaminate the first punches 206 and the first dies 208. As such, the first punches 206 and the first dies 208 may not contact the adhesive 716, which may increase a longevity of the first punches 206 and/or the first dies 208, and prevent debris, for example, accumulating on the first punches 206 and/or the first dies 208.

Although described as sealing longitudinal ends of the container 122, the first upper press 210 and the first lower press 212 (as well as the other presses described herein), may be used to seal other portions of the container 122. For example, the presses may be used to seal a seam along a top of the container 122, or along other sides of the container 122. In such instances, the presses may be reconfigured to permit their operation and to enclose upon the portions of the container 122 to seal the packaging material 114 together.

Figure 8:
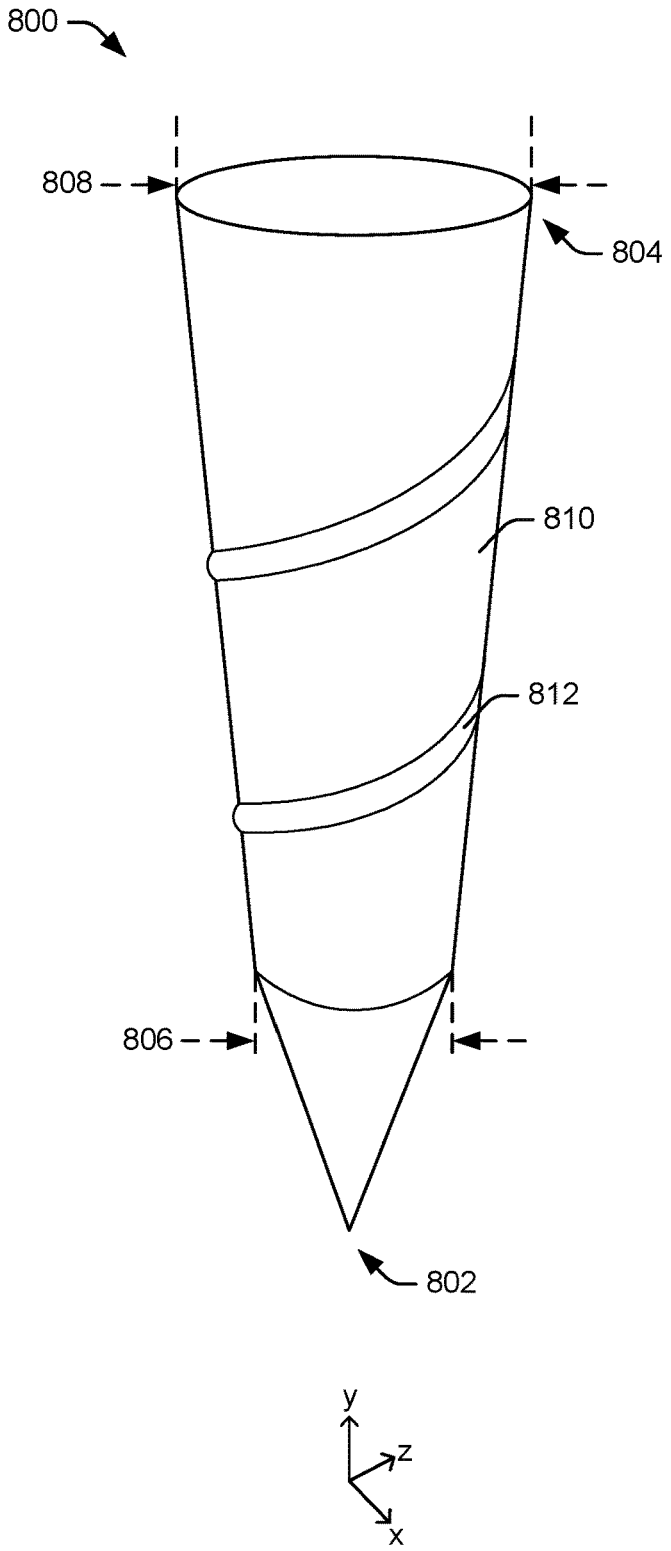
FIG. 8 illustrates an example punch of the sealing mechanism of FIG. 1, according to examples of the present disclosure.

FIG. 8 illustrates an example profile of a punch 800, which may be representative of a punch usable by the first press 204 and/or the second press 220. The punch 800 may include a first end 802 and a second end 804 spaced apart from the first end 802 (e.g., in the y-direction). The first end 802 may include a pointed tip to pierce through the packaging material 114.

The punch 800 may include a taper between the first end 802 and the second end 804. For example, proximate the first end 802, the punch 800 may include a first cross-sectional dimension 806, and proximate the second end 804, the punch 800 may include a second cross-sectional dimension 808. The second cross-sectional dimension 808 may be greater than the first cross-sectional dimension 806. In some instances, the taper may assist in pushing the packaging material 114 through holes in the packaging material 114 formed by the punch 800. Additionally, upon retraction of the punch 800, the taper may prevent the punch 800 snapping or otherwise catching on sidewalls of the hole.

In some instances, an exterior surface 810 of the punch 800 may include extrusions 812 that spiral along the exterior surface 810, between the first end 802 and the second end 804. In some instances, the extrusions 812 may assist in pushing the packaging material 114 to from the tabs. Alternatively, rather than including the extrusions 812, the punch 800 may include indents that spiral along the exterior surface 810. Still, in some instances, the punch 800 may include ribs along the exterior surface 810 that assist in piercing through the packaging material 114, forming the flaps, and/or pushing the flaps through the packaging material 114.

Figure 9:
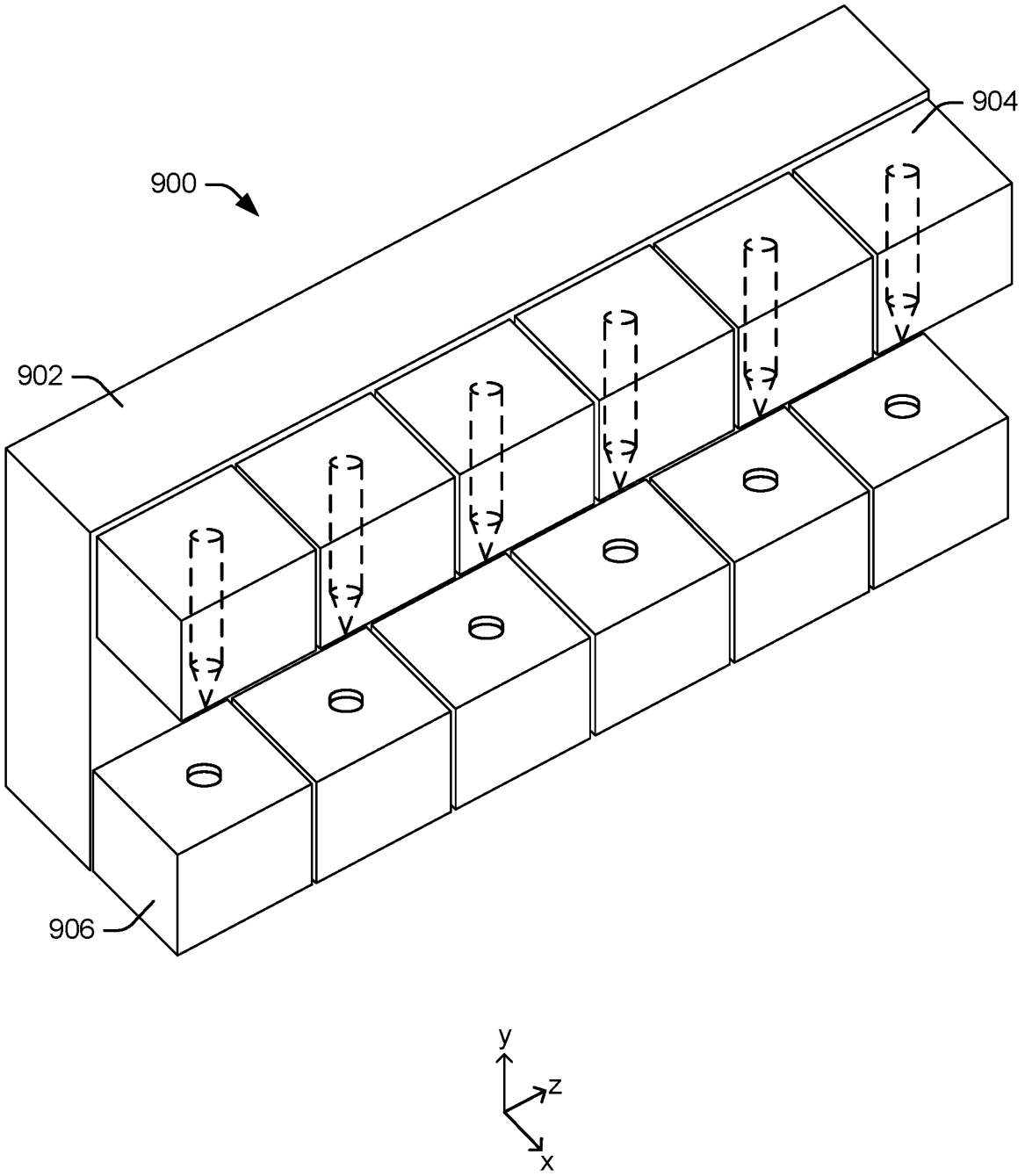
FIG. 9 illustrates an alternative example of a sealing mechanism for sealing portions of a container, according to examples of the present disclosure.

FIG. 9 illustrates an alternative example of a press 900 that may be used to secure portions of a container 122. The press 900 may include a "C-shaped" design that is enclosed over/upon longitudinal ends of the container 122. For example, the press 900 may include a frame 902 to which punches 904 and dies 906 are operably coupled. In some instances, the punches 904 and the dies 906 translate along the frame 902 (e.g., in the y-direction) to compress the packaging material 114, pierce through the packaging material 114, and to form tabs that hold the packaging material 114 together. Operation of the punches 904 and the dies 906 may be otherwise similar to the embodiment described herein. Actuators may control operation of the punches 904 and/or dies 906 to compress the packaging material 114 and seal the container 122.

Figure 10A:
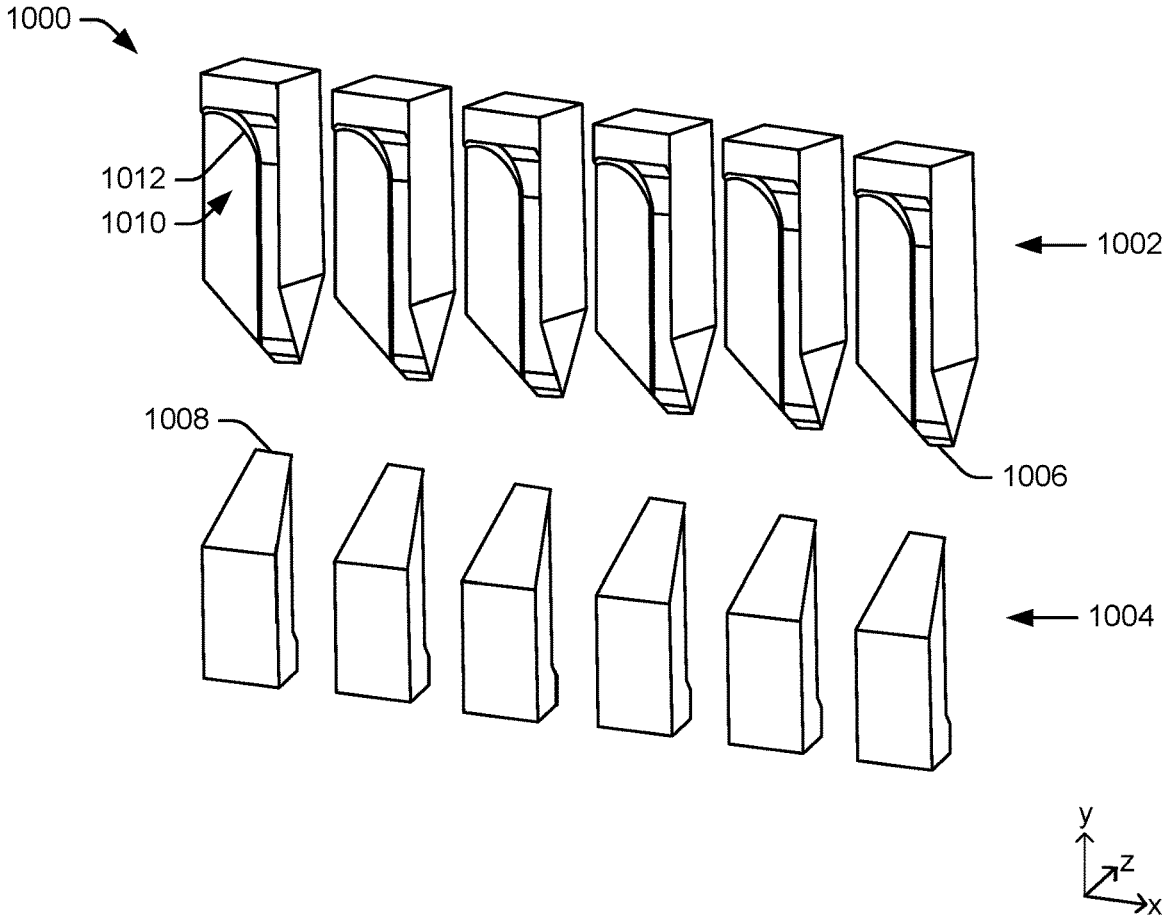
FIGS. 10A-10E illustrate example punches for sealing portions of a container, according to examples of the present disclosure.

FIGS. 10A-10D illustrate an alternative example of a press 1000 that may be used to secure portions of a container 122. As shown in FIG. 10A, in some instances, the press 1000 may include first punches (or dies) 1002 and second punches (or dies) 1004. The first punches 1002 and the second punches 1004 are configured to actuate in a direction towards one another to pierce through the packaging material 114 while forming the container 122. Individual punches of the first punches 1002 may include a piercing end 1006 to punch through the packaging material 114, while individual punches of the second punches 1004 may include a piercing end 1008 to punch through the packaging material 114.

In some instances, the first punches 1002 may include a channel, receptacle, or trough 1010 in which at least a portion of the second punches 1004 are received. For example, when the first punches 1002 and the second punches 1004 actuate towards one another, and pierce through the packaging material 114, the piercing end 1008 of the second punches 1004 may reside within the trough 1010. In this instance, the piercing end 1008 of the second punches 1004 may be at least partially encapsulated within the trough 1010. Furthermore, the trough 1010 may include a flared section 1012 that directions a tab of the packaging material 114 outward of the trough 1010.

Although not shown, actuators may couple to the first punches 1002 and the second punches 1004. Additionally, in some instances, the press 1000 may further include one or more plates that compress the packaging material 114, either before, after, or simultaneously with the first punches 1002 and the second punches 1004 punching through the packaging material 114.

Figure 10B:
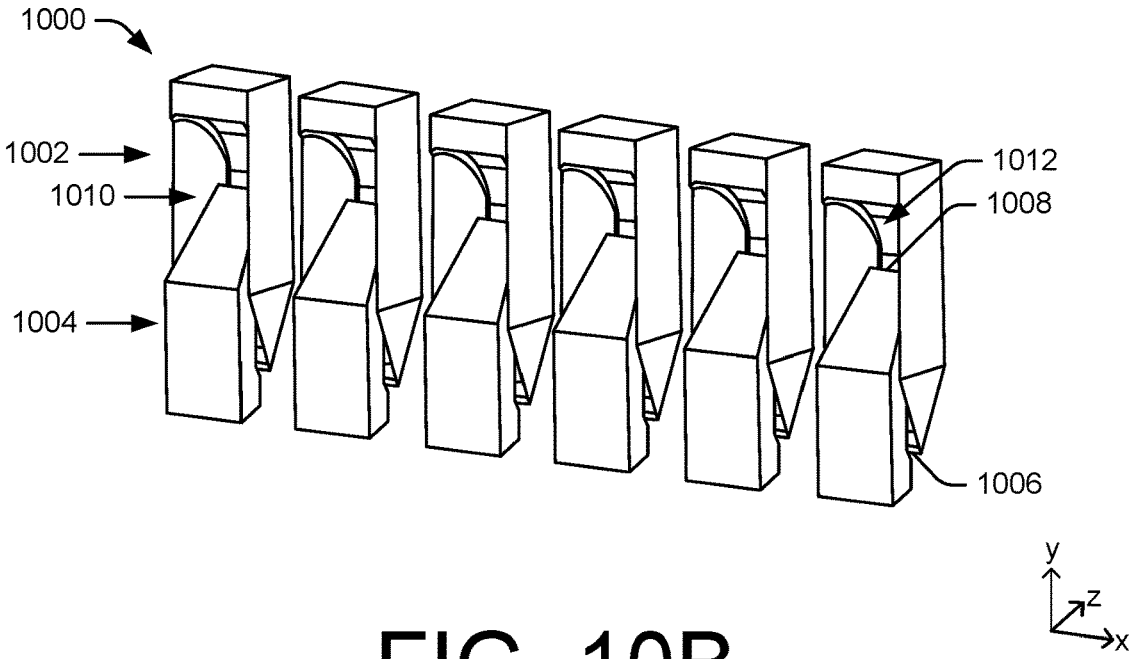

Turning to FIG. 10B, the first punches 1002 and the second punches 1004 are shown being engaged. As introduced above, the piercing end 1008 of the second punches 1004 may be disposed within the trough 1010 of the first punches 1002. Additionally, the piercing end 1006 of the first punches 1002 may translate along an exterior surface of the second punches 1004. As the second punches 1004 are actuated upward (e.g., in the y-direction), the packaging material 114 is directed out of the trough 1010 via the flared section 1012.

Figure 10C:
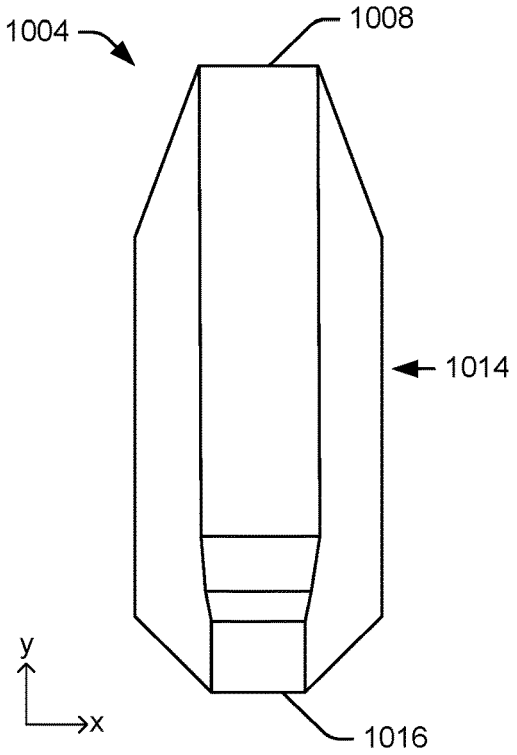

FIG. 10C illustrates a view of one of the second punches 1004. The second punch 1004 is shown including the piercing end 1008, and a body 1014 that extends between the piercing end 1008 and a distal end 1016. A side of the second punch 1004, such as a back, that is insertable into the trough 1010 may include tapered sidewalls to match a contour of the interior surface of the trough 1010. For example, the second punch 1004 may include a trapezoidal cross-section (X-Z plane).

Figure 10E:
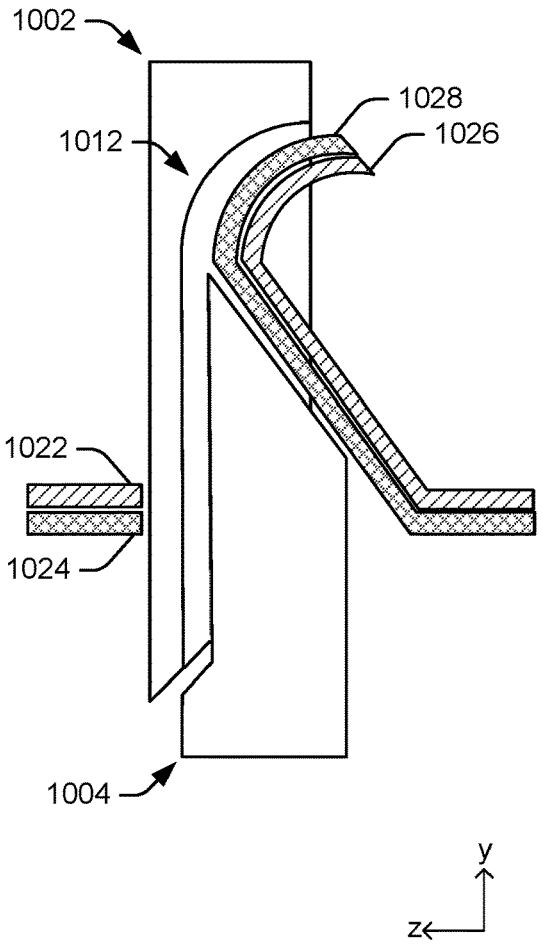
Figure 10D:
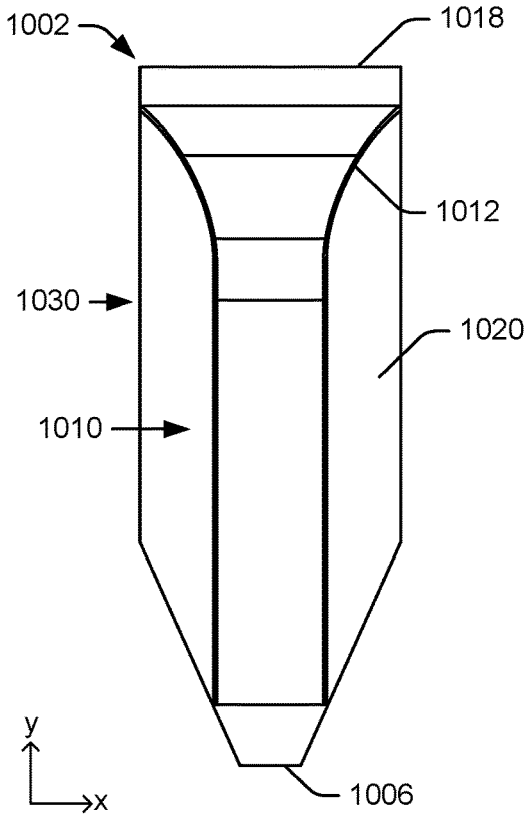

FIG. 10D illustrates a view of one of the first punches 1002. The first punch 1002 is shown including the piercing end 1006, and a body 1030 that extends between the piercing end 1006 and a distal end 1018. The body 1030 forms the trough 1010 in which a portion of the second punch 1004 is received. Additionally, sidewalls 1020 of the trough 1010 may taper outward, from a bottom of the trough 1010 to a top of the trough 1010, so as to match the contour of the lower press 1000 (e.g., the trapezoidal cross section). The trough 1010 is further shown including the flared section 1012 to direct the packaging material 114 of the trough 1010.

FIG. 10E illustrates an operation of the first punch 1002 and the second punch 1004. The first punch 1002 and the second punch 1004 are shown piercing through a first piece of packaging material 1022 and a second piece of packaging material 1024. As the first punch 1002 and the second punch 1004 are actuated towards one another, the second punch 1004 creates a first tab 1026 from the first piece of packaging material 1022 and a second tab 1028 from the second piece of packaging material 1024. The first tab 1026 and the second tab 1028 are channeled within the trough 1010, via the sidewalls 1020, and are advanced towards the flared section 1012 as the first punch 1002 and the second punch 1004 continue to actuate. The flared section 1012 forces the first tab 1026 and the second tab 1028 out of the trough 1010 such that the first piece of packaging material 1022 and the second piece of packaging material 1024 are folded over themselves (e.g., in the z-direction). The first tab 1026 and the second tab 1028 may curl or otherwise fold over an upper portion of the second press 1004 and back in a direction towards the first piece of packaging material 1022 and the second piece of packaging material 1024. Therein, in some instances, the first tab 1026 and the second tab 1028 may be compressed to secure the first tab 1026 and the second tab 1028 in place and prevent the first tab 1026 and the second tab 1028 separating.

Figure 11:
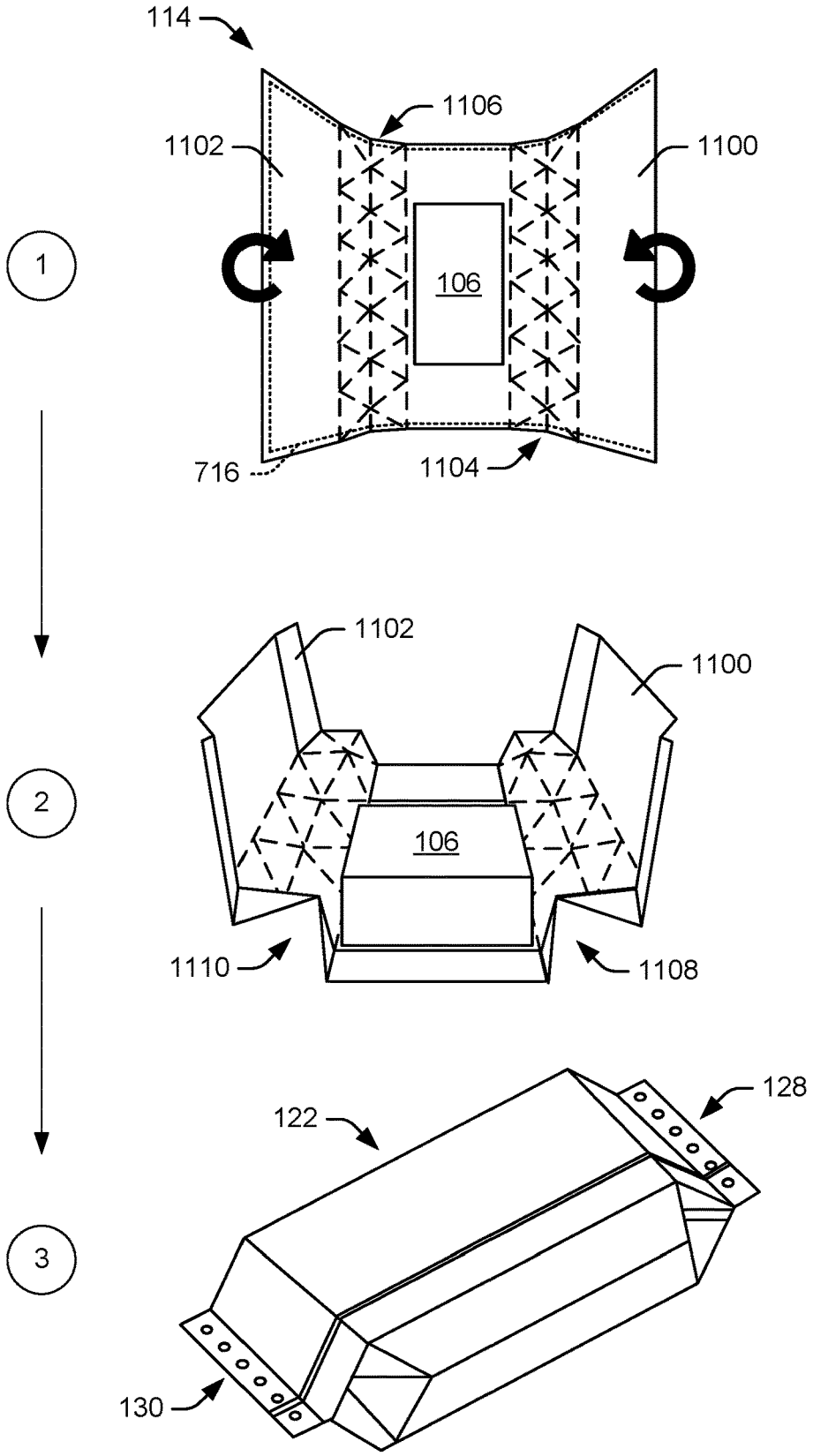
FIG. 11 illustrates an example flow of operations for forming a container and sealing portions of the container, according to examples of the present disclosure.

FIG. 11 illustrates a sheet of the packaging material 114 at various stages as the container 122 is formed. At "1," a first side 1100 of the sheet of the packaging material 114 may be folded over the item 106 to be packed. After the first side 1100 is folded, a second side 1102 may be folded over the first side 1100. In some instances, the first side 1100 and the second side 1102 may be folded one at a time. In some instances, before the first side 1100 and the second side 1102 are folded, a first set of crease lines 1104 and a second set of crease lines 1106 may be formed on an upper surface of the packaging material 114. The first set of crease lines 1104 and the second set of crease lines 1106 may be separated by a distance that is equal to or slightly greater than a width of the item 106 to be packed in the container 122. The first set of crease lines 1104 and the second set of crease lines 1106 may include one or more crease lines formed, for example, using one or more rollers of the machine 102.

As also shown at "1," the adhesive 716 may be applied along sides of the packaging material 114 to form a C-pattern. The adhesive 716 may be omitted from portions of the first side 1100 as the packaging material 114 may contact the item 106 once folded. However, in other instances, the adhesive 716 may disposed in a different pattern about or more, such as all, sides of the packaging material 114.

At "2," a first gusset 1108 and a second gusset 1110 may be formed as the first side 1100 and the second side 1102 are folded. Depending on the configuration of the container 122, the first gusset 1108 and the second gusset 1110 maybe folded inward-facing or outward-facing.

At "3," the sealing mechanism 124, including the first punches 206, the first dies 208, the second punches 222, and the second dies 224 may secure longitudinal ends of the container 122. The first tabs 136 and the second tabs 138 formed at the first longitudinal end 128 and the second longitudinal end 130, respectively, may prevent the container 122 opening prior to the adhesive 716 curing. In this manner, the sealing mechanism 124 serves to provide a redundant hold force during shipping without introducing additional materials.

FIGS. 12A-12D illustrate different holes and tabs to seal the container 122. The views shown in FIGS. 12A-12D may illustrate a bottom of the container 122 with the tabs, at the first longitudinal end 128. However, it is to be understood that the tabs may be formed on a top of the container 122 at the first longitudinal end 128 and/or at other seams of the container 122.

Figure 12B:
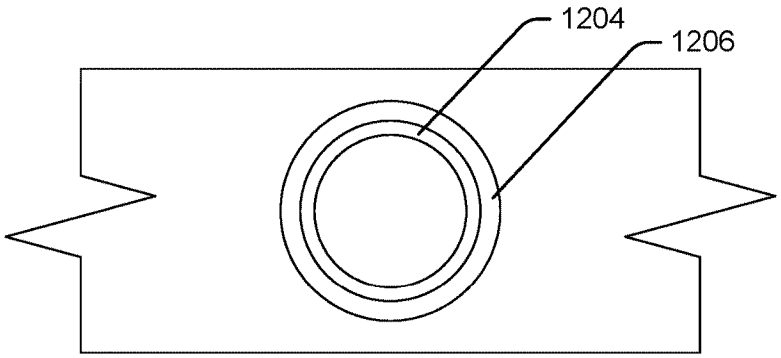
FIGS. 12A-12D illustrate various examples of tabs formed by a sealing mechanism for sealing portions of a container, according to examples of the present disclosure.
Figure 12D:
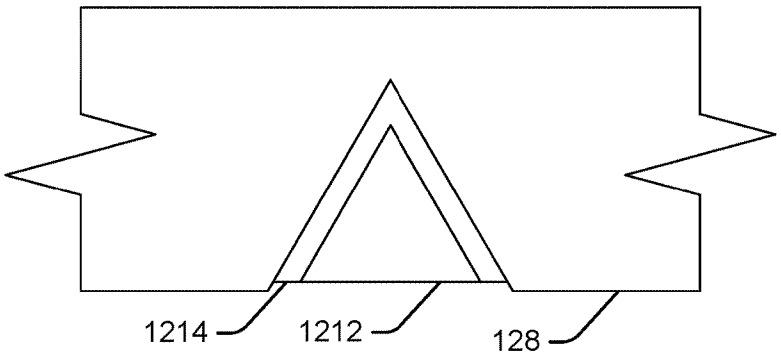
Figure 12A:
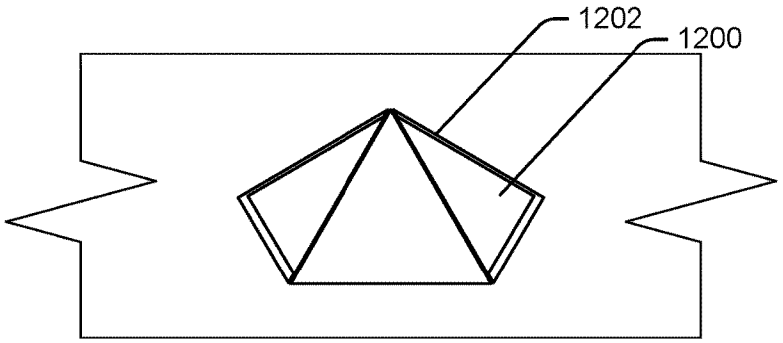

In FIG. 12A, triangular-shaped tabs are shown. The tabs, for example, may be formed from a triangular-shaped punch. The tabs are formed via at least a first piece 1200 of the packaging material 114 and a second piece 1202 of the packaging material 114. For example, the first piece 1200 of the packaging material 114 may be formed from a piece of the packaging material 114 on a top of the container 122, while the second piece 1202 of the packaging material 114 may be formed from a piece of the packaging material 114 on a bottom of the container 122. As shown, the first piece 1200 of the packaging material 114 and the second piece 1202 of the packaging material 114 may be folded to prevent separation of the first piece 1200 of the packaging material 114 and the second piece 1202 of the packaging material 114. Thereafter, the first piece 1200 of the packaging material 114 and the second piece 1200 of the packaging material 114 may be pressed together.

In FIG. 12B, circular-shaped tabs are shown. The tabs, for example, may be formed from a circular-shaped punch. The tabs are formed via at least a first piece 1204 of the packaging material 114 and a second piece 1206 of the packaging material 114. For example, the first piece 1204 of the packaging material 114 may be formed from a piece of the packaging material 114 on the top of the container 122, while the second piece 1206 of the packaging material 114 may be formed from a piece of the packaging material 114 on the bottom of the container 122. Thereafter, the first piece 1204 of the packaging material 114 and the second piece 1206 of the packaging material 114 may be pressed together.

Figure 12C:
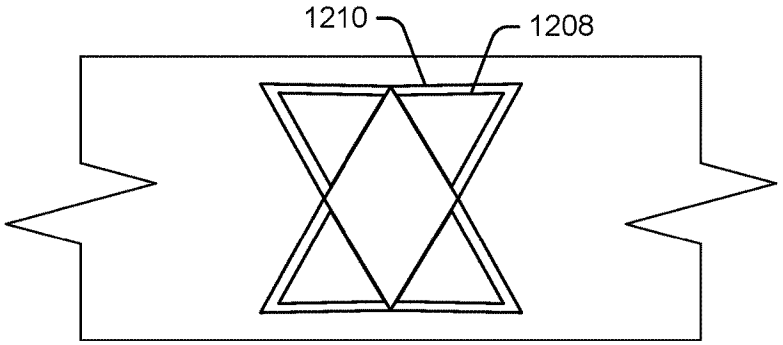
Figure 13:
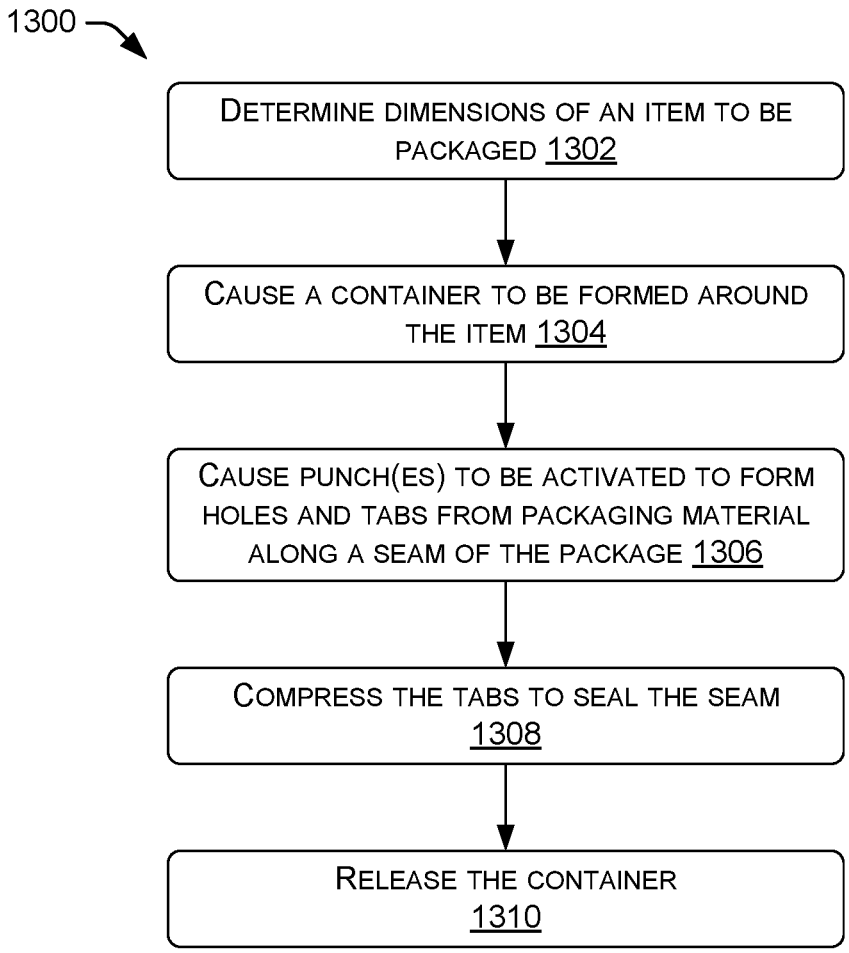
FIG. 13 illustrates an example process for sealing a container, according to examples of the present disclosure.

In FIG. 12C, triangular-shaped tabs are shown. The tabs, for example, may be formed from a diamond-shaped punch. The tabs are formed via at least a first piece 1208 of the packaging material 114 and a second piece 1210 of the packaging material 114. For example, the first piece 1208 of the packaging material 114 may be formed from a piece of the packaging material 114 on a top of the container 122, while the second piece 1210 of the packaging material 114 may be formed from a piece of the packaging material 114 on a bottom of the container 122. As shown, the first piece 1208 of the packaging material 114 and the second piece 1210 of the packaging material 114 may be folded to prevent separation of the first piece 1208 of the packaging material 114 and the second piece 1210 of the packaging material 114. Thereafter, the first piece 1208 of the packaging material 114 and the second piece 1210 of the packaging material 114 may be pressed together.

In FIG. 12D, triangular-shaped tabs are shown. As shown, the tabs may be folded over along the first longitudinal end 128 and in a direction into the container 122 The tabs are formed via at least a first piece 1212 of the packaging material 114 and a second piece 1214 of the packaging material 114. For example, the first piece 1212 of the packaging material 114 may be formed from a piece of the packaging material 114 on a top of the container 122, while the second piece 1214 of the packaging material 114 may be formed from a piece of the packaging material 114 on a bottom of the container 122. As shown, the first piece 1212 of the packaging material 114 and the second piece 1214 of the packaging material 114 may be folded to prevent separation of the first piece 1212 of the packaging material 114 and the second piece 1214 of the packaging material 114. Thereafter, the first piece 1212 of the packaging material 114 and the second piece 1214 of the packaging material 114 may be pressed together.

Although particular shaped tabs are shown, the punches and/or dies may include other shapes. In some instances, the portions of the tabs that are folded may be between about two mm and about 10 mm. In some instances, the portions of the tabs that are folded may not exceed six mm in length and four mm in width. However, in some instances, the size of the tabs may differ with various corrugate thicknesses and types.

FIG. 11 illustrates a process 1300 for sealing a container. The process 1300 described herein is illustrated as collections of blocks in logical flow diagrams, which represent a sequence of operations, some or all of which may be implemented in hardware, software, or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed. For discussion purposes, the process 1300 is described with reference to the environments, architectures, devices, and systems described in the examples herein, such as, for example those described with respect to FIGS. 1-12, although the process 1300 may be implemented in a wide variety of other environments, architectures, devices, and systems.

At 1302, the process 1300 may include determining dimensions of an item to be packaged. For example, sensor(s) 112 of the machine 102 may determine the dimensions of the item 106. As explained herein, the dimensions of the item 106 are usable to appropriately size a container around the item 106.

At 1304, the process 1300 may include causing a container to be formed around the item. For example, folding mechanisms of the machine 102 may fold, crease, or otherwise form the container 122 around the item 106. In some instances, the container 122 may be formed around the item 106, but the container 122 itself may not be enclosed (e.g., sealed).

For example, the packaging material 114 may be wrapped around the item 106, but ends or seams of the packaging material 114 may not be secured.

At 1306, the process 1300 may include causing punch(es) to be activated to form holes and tabs from packaging material along a seam of the package. For example, press(es) may actuate to form the holes, and correspondingly, the tabs from the packaging material of the first holes, respectively. In some instances, the press(es) include a plurality of punches that pierce through the packaging material 114, as well as a plurality of dies that receive the plurality of punch(es), respectively. In some instances, the punch(es) and dies may actuate in directions towards one another, so as to pierce through the packaging material 114.

At 1308, the process 1300 may include compressing the tabs to seal the seam. For example, plates of the press(es) may be actuated to compress the tabs and prevent separation of the packaging material along the seam.

At 1310, the process 1300 may include causing the package to be released. In some instances, causing the container to be released may include opening the press(es) of the machine 102 such that the container 122 may be removed from the machine 102 and further processed.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A method comprising:

causing packaging material to surround an item;

causing one or more first punches to actuate to pierce through the packaging material at a first location, wherein individual first punches of the one or more first punches are independently actuatable;

causing one or more first dies to actuate to receive a first portion of the individual first punches of the one or more first punches, wherein individual first dies of the one or more first dies are independently actuatable;

causing one or more second punches to actuate to pierce through the packaging material at a second location, wherein individual second punches of the one or more second punches are independently actuatable;

causing one or more second dies to actuate to receive a second portion of the individual second punches of the one or more second punches, wherein individual second dies of the one or more second dies are independently actuatable;

causing a first press to compress the packaging material at the first location; and causing a second press to compress the packaging material at the second location.

2. The method of claim 1, wherein:

the individual first punches create first tabs from the packaging material that are compressed via the first press to secure the packaging material together at the first location; and the individual second punches create second tabs from the packaging material that are compressed via the second press to secure the packaging material together at the second location.

3. The method of claim 2, wherein:

at the first location, the packaging material includes a first segment of a first layer of the packaging material and a second segment of a second layer of the packaging material;

the first tabs are created from the first segment of the first layer and the second segment of the second layer;

the first tabs are compressed against the second layer of the packaging material;

at the second location, the packaging material includes a third segment of the first layer of the packaging material and a fourth segment of the second layer of the packaging material;

the second tabs are created from the third segment of the first layer and the fourth segment of the second layer; and the second tabs are compressed against the second layer of the packaging material.

4. The method of claim 1, wherein:

the one or more first punches are arranged in a first line;

the individual first punches are equidistantly spaced apart from one another along the first line;

the one or more second punches are arranged in a second line; and the individual second punches are equidistantly spaced apart from one another along the second line.

5. The method of claim 1, wherein at least one of:

the first location corresponds to a first longitudinal end of a container; or the second location corresponds to a second longitudinal end of the container.

6. The method of claim 1, further comprising applying an adhesive adjacent to the first location and the second location.

7. The method of claim 6, wherein:

the one or more first punches form one or more first holes in the packaging material;

the one or more first holes are spaced apart from a first seam of the packaging material by a first distance;

a first section of the adhesive is disposed on the packaging material at a second distance from the first seam, the second distance being greater than the first distance;

the one or more second punches form one or more second holes in the packaging material;

the one or more second holes are spaced apart from a second seam of the packaging material by a third distance; and a second section of the adhesive is disposed on the packaging material at a fourth distance from the second seam, the fourth distance being greater than the third distance.

8. The method of claim 1, wherein:

the one or more first punches are at least partially disposed through the packaging material at the first location during compression of the packaging material via the first press; and the one or more second punches are at least partially disposed through the packaging material at the second location during compression of the packaging material via the second press.

9. The method of claim 1, wherein:

the first press includes a plurality of first upper presses and a plurality of first lower presses;

individual first presses of the plurality of first upper presses include a first upper plate and the individual first punches of the one or more first punches;

individual second presses of the plurality of first lower presses include:

a first lower plate that compresses the packaging material between the first upper plate, and individual first dies of the one or more first dies;

the second press includes a plurality of second upper presses and a plurality of second lower presses;

individual third presses of the plurality of second upper presses include a second upper plate and the individual second punches of the one or more second punches; and individual fourth presses of the plurality of second lower presses include:

a second lower plate that compresses the packaging material between the second upper plate, and individual second dies of the one or more second dies.

10. A method comprising:

causing a first punch to actuate in a first direction to pierce through a packaging material that is used to form a container, between a top surface of the packaging material and a bottom surface of the packaging material, wherein the first punch forms at least a first tab from the top surface of the packaging material and a second tab from the bottom surface of the packaging material;

causing a first die to actuate in a second direction to receive a first portion of the first punch;

causing a second punch to actuate in the first direction to pierce through the packaging material, between the top surface and the bottom surface, wherein the second punch forms at least a third tab from the top surface of the packaging material and a fourth tab from the bottom surface of the packaging material;

causing a second die to actuate in the second direction to receive a second portion of the second punch;

causing a first upper press and a first lower press to actuate to compress the packaging material at a first end of the container, wherein at least the first tab and the second tab are compressed via the first lower press against the bottom surface of the packaging material; and causing a second upper press and a second lower press to actuate to compress the packaging material at a second end of the container, wherein at least the third tab and the fourth tab are compressed via the second lower press against the bottom surface of the packaging material.

11. The method of claim 10, further comprising:

causing a third punch to actuate in the first direction to pierce through the packaging material, between the top surface and the bottom surface, at the first end of the container;

causing a third die to actuate in the second direction to receive a third portion of the third punch;

causing a fourth punch to actuate in the first direction to pierce through the packaging material, between the top surface and the bottom surface, at the second end of the container;

causing a fourth die to actuate in the second direction to receive a fourth portion of the fourth punch;

causing a third upper press and a third lower press to actuate to compress the packaging material at the first end of the container; and causing a fourth upper press and a fourth lower press to actuate to compress the packaging material at the second end of the container.

12. The method of claim 11, wherein:

the first upper press, the second upper press, the third upper press, and the fourth upper press are independently actuatable; and the first lower press, the second lower press, the third lower press, and the fourth lower press are independently actuatable.

13. A method comprising:

causing a packaging material to surround an item;

causing one or more first punches to actuate to pierce through the packaging material at a first location to form first tabs, wherein at the first location, the packaging material includes a first segment of a first layer of the packaging material and a second segment of a second layer of the packaging material, and wherein the first tabs are created from the first segment of the first layer and the second segment of the second layer;

causing one or more second punches to actuate to pierce through the packaging material at a second location to form second tabs, wherein at the second location, the packaging material includes a third segment of the first layer of the packaging material and a fourth segment of the second layer of the packaging material, and wherein the second tabs are created from the third segment of the first layer and the fourth segment of the second layer;

causing a first press to compress the packaging material at the first location to compress the first tabs to secure the packaging material together, wherein the first tabs are compressed against the second layer of the packaging material; and causing a second press to compress the packaging material at the second location to compress the second tabs to secure the packaging material together, wherein the second tabs are compressed against the second layer of the packaging material.

14. The method of claim 13, further comprising:

causing one or more first dies to actuate to receive a first portion of individual first punches of the one or more first punches; and causing one or more second dies to actuate to receive a second portion of individual second punches of the one or more second punches.

15. The method of claim 13, wherein at least one of:

the first location corresponds to a first longitudinal end of a container; or the second location corresponds to a second longitudinal end of the container.

16. The method of claim 13, further comprising applying an adhesive adjacent to the first location and the second location.

17. The method of claim 13, wherein at least one of:

the one or more first punches form first holes that are triangular shaped, circular shaped, diamond shaped, or square shaped;

the one or more second punches form second holes that are triangular shaped, circular shaped, diamond shaped, or square shaped; or the first tabs or the second tabs are triangular shaped, circular shaped, diamond shaped, or square shaped.

* * * * *